US011098424B2

(12) United States Patent
Azuma

(10) Patent No.: US 11,098,424 B2
(45) Date of Patent: Aug. 24, 2021

(54) SEWING MACHINE

(71) Applicant: JANOME SEWING MACHINE CO., LTD., Tokyo (JP)

(72) Inventor: Toyohiro Azuma, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 184 days.

(21) Appl. No.: 16/506,860

(22) Filed: Jul. 9, 2019

(65) Prior Publication Data

US 2020/0048808 A1 Feb. 13, 2020

(30) Foreign Application Priority Data

Aug. 9, 2018 (JP) ..... JP2018-149871

(51) Int. Cl.
*D05B 29/00* (2006.01)
*D05B 27/06* (2006.01)

(52) U.S. Cl.
CPC ..... *D05B 29/00* (2013.01); *D05B 27/06* (2013.01)

(58) Field of Classification Search
CPC ..... D05B 29/00; D05B 29/06; D05B 29/08; D05B 27/04; D05B 27/06; D05B 27/24
See application file for complete search history.

(56) References Cited

U.S. PATENT DOCUMENTS 2,266,140 A * 12/1941 Zeier ..... D05B 1/06 112/199
3,935,826 A * 2/1976 Nicolay ..... D05B 27/04 112/320

(Continued)

FOREIGN PATENT DOCUMENTS

GB 208968 A * 1/1924 ..... D05B 27/04
JP 2013052122 A * 3/2013 ..... D05B 29/00
JP 5885289 B 3/2016

OTHER PUBLICATIONS

English translation of JP2013052122 (Mar. 2013), obtained via espacenet.com (last visited Mar. 18, 2021). (Year: 2013).*

(Continued)

*Primary Examiner* — Alissa L Hoey
*Assistant Examiner* — Patrick J. Lynch
(74) *Attorney, Agent, or Firm* — Nakanishi IP Associates, LLC

(57) ABSTRACT

A sewing machine includes: a presser spring depressing a presser bar; a presser main body fixed thereto, including a presser; a lower feed dog protruding further upward than a needle plate, to feed a sewing target rearward; an upper feed mechanism above the lower feed dog, that includes an upper feed dog behind a needle location and feeds the sewing target rearward via the upper and lower feed dogs; and a spring presser release mechanism relatively movably mounted on the presser bar, including a transmission member transmitting presser spring force to the presser bar, and operating when the lower contacts the upper feed dog, lifting the transmission member relative to the presser bar, to release the force applied thereto. The movement of the transmission member with respect to the presser bar during spring presser release mechanism operation matches a movement of the lower feed dog protruding from the needle plate.

2 Claims, 17 Drawing Sheets

(56) References Cited

U.S. PATENT DOCUMENTS

| | | | | | |
|---|---|---|---|---|---|
| 4,323,020 | A * | 4/1982 | Thompson | D05B 29/00 | 112/237 |
| 4,503,794 | A * | 3/1985 | Ishihara | D05B 27/04 | 112/313 |
| 4,589,364 | A * | 5/1986 | Yamamoto | D05B 27/04 | 112/311 |
| 4,724,783 | A * | 2/1988 | Morimoto | D05B 27/22 | 112/311 |
| 2011/0146551 | A1 * | 6/2011 | Bardh | D05B 29/02 | 112/237 |

OTHER PUBLICATIONS

Final Rejection dated Jun. 15, 2021 issued in Taiwanese Patent Application No. 108124903, with English Translation (9 pages).

* cited by examiner

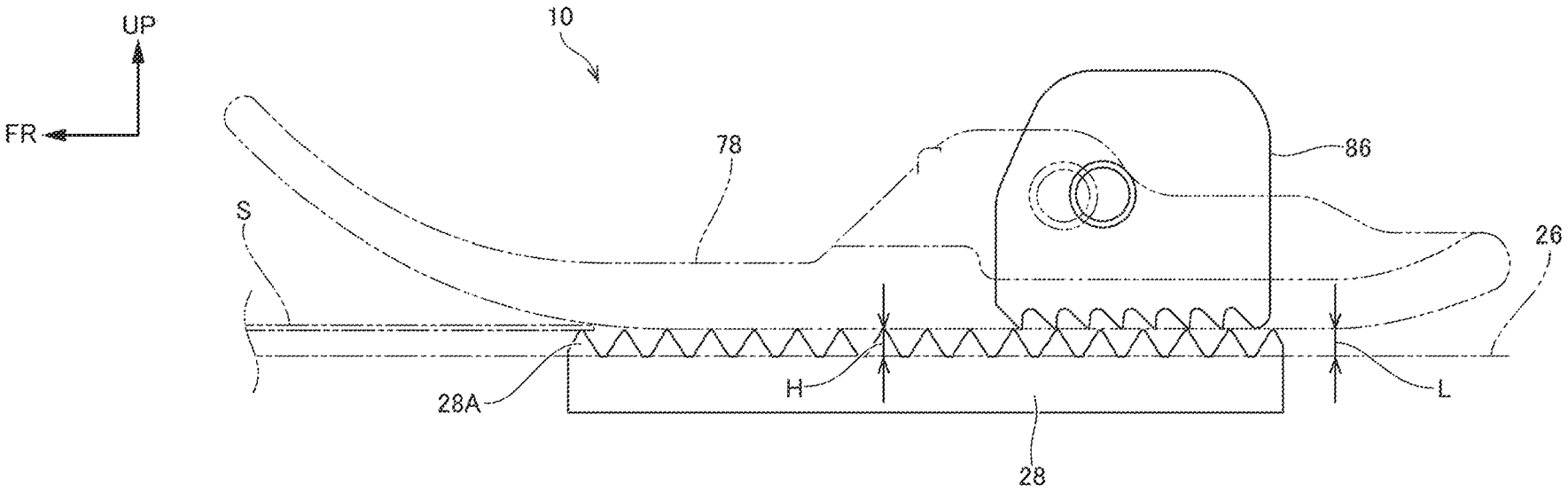
Fig1.A

SEWING MACHINE

CROSS REFERENCE TO RELATED APPLICATIONS

This application is based on and claims the benefit of priority to Japanese Patent Application No. 2018-149871 filed on Aug. 9, 2018, the contents of which are hereby incorporated by reference in their entirety.

BACKGROUND OF THE INVENTION

1. Field of the Invention

The present invention relates to a sewing machine.

2. Description of the Related Art

A sewing machine described in Patent document 1 listed below includes an upper feed dog, and is configured to feed a sewing target backward using the upper feed dog together with a lower feed dog. This allows deviation in sewing of a sewing target or the like to be reduced. Furthermore, the sewing machine includes a release mechanism that allows the force applied to a presser bar by a presser spring to be released. Such a sewing machine is configured to allow the release mechanism to suppress the effects of such a presser when the sewing target is to be fed backward by the lower feed dog and the upper feed dog. Specifically, when the lower feed dog configured such that it protrudes from a needle plate comes in contact with the upper feed dog directly or otherwise indirectly via the sewing target, the release mechanism releases the force applied to the presser bar by the presser spring, which allows the presser to be moved further upward than the lower feed dog. More specifically, a spring release base (transmission member) configured to transmit the force applied to the presser bar by the presser spring is moved relatively upward with respect to the presser bar, thereby releasing the force applied to the presser bar by the presser spring.

In the sewing machine described above, the front end portions of the lower feed dog and the upper feed dog are each arranged on the front side of a needle. On the other hand, the rear end portions of the lower feed dog and the upper feed dog are each arranged on the rear side of the needle location point. That is to say, the lower feed dog and the upper feed dog are arranged on both the front side and the rear side of the needle location point. Accordingly, even if the presser is moved further upward than the lower feed dog in the sewing target feeding operation, this arrangement is capable of feeding the sewing target backward in a state in which the sewing target is interposed between the lower feed dog and the upper feed dog in the upper-lower direction.

In some sewing machines including an upper feed dog, the entire region of the upper feed dog is arranged on the rear side of the needle location point. With such a sewing machine, when the sewing target is positioned on the rear side of the needle location point, the sewing target is fed in a state in which the sewing target is interposed between the upper feed dog and the lower feed dog.

RELATED ART DOCUMENTS

Patent Documents

[Patent document 1]

Japanese Patent No. 5,885,289

However, in a case of a sewing machine configured such that the entire region of the upper feed dog is arranged on the rear side of the needle location position, such a sewing machine has the following issue. That is to say, when the feeding of the sewing target is started, the sewing target is arranged on the front side of the needle. In this state, the sewing target does not reach the upper feed dog. Accordingly, in this stage, the sewing target is held such that it is interposed between the lower feed dog and the presser. However, such a sewing machine is configured as described above such that, when the sewing target is to be fed, the force applied to the presser bar by the presser spring is released, and the presser is moved further upward than the lower feed dog. With this arrangement, at the start of feeding of the sewing target, the pressing force applied by the presser (force applied by the presser spring) has no effect on the sewing target. Accordingly, this arrangement has the potential to cause an issue in that the sewing target cannot be satisfactorily fed.

In view of the above-described fact, it is a purpose of the present invention to provide a sewing machine with improved feeding performance.

SUMMARY OF THE INVENTION

One or more embodiments of the present invention provide a sewing machine including: a needle plate; a presser bar; a presser spring configured to apply a force to a presser bar toward a lower side; a presser main body fixed to the presser bar, and including a presser that presses a sewing target; a lower feed dog arranged on the lower side of the presser, and configured to protrude further upward from the needle plate, and to feed the sewing target toward a rear side; an upper feed mechanism arranged on the upper side of the lower feed dog, including an upper feed dog arranged on the rear side of a needle location point, and configured to be operated so as to feed the sewing target toward the rear side by the upper feed dog and the lower feed dog; a feed driving unit configured to drive the upper feed dog such that it performs an upper feeding operation; and a spring presser release mechanism mounted on the presser bar and configured to be moved relatively to the presser bar, including a transmission member that transmits the force applied by the presser spring to the presser bar.

When the lower feed dog comes in contact with the upper feed dog, the spring presser release mechanism controls the transmission member to move toward the upper side with respect to the presser bar, so as to release the force applied to the presser bar.

A moving distance of the transmission member controlled by the spring presser release mechanism with respect to the presser bar is set to be the same as a protrusion height of the lower feed dog that protrudes upward from the needle plate.

One or more embodiments of the present invention provide the sewing machine. The upper feed mechanism is coupled to the presser main body such that the upper feed mechanism and the presser main body are configured as a unit. The upper feed mechanism comprises a feed coupling portion detachably coupled to the feed driving unit. The presser main body comprises a presser fixing portion detachably fixed to the presser bar.

With a sewing machine according to at least one embodiment of the present invention, this arrangement provides improved feeding performance for a sewing target.

BRIEF DESCRIPTION OF THE DRAWINGS

FIG. 1A is a side view as viewed from the right side for explaining the start of a feeding operation of a sewing machine for a sewing target according to the present embodiment.

FIG. 8A is a side view showing a state in which a needle mechanism is positioned before the top dead center, and FIG. 8B is a side view showing a state after the operation of the needle mechanism is reversed at the top dead center point.

FIG. 9A is a side view showing a state in which the needle mechanism is positioned before a needle plate, and FIG. 9B is a side view showing a state in which the needle mechanism is positioned at the bottom dead center point.

DETAILED DESCRIPTION

Figure 1B:
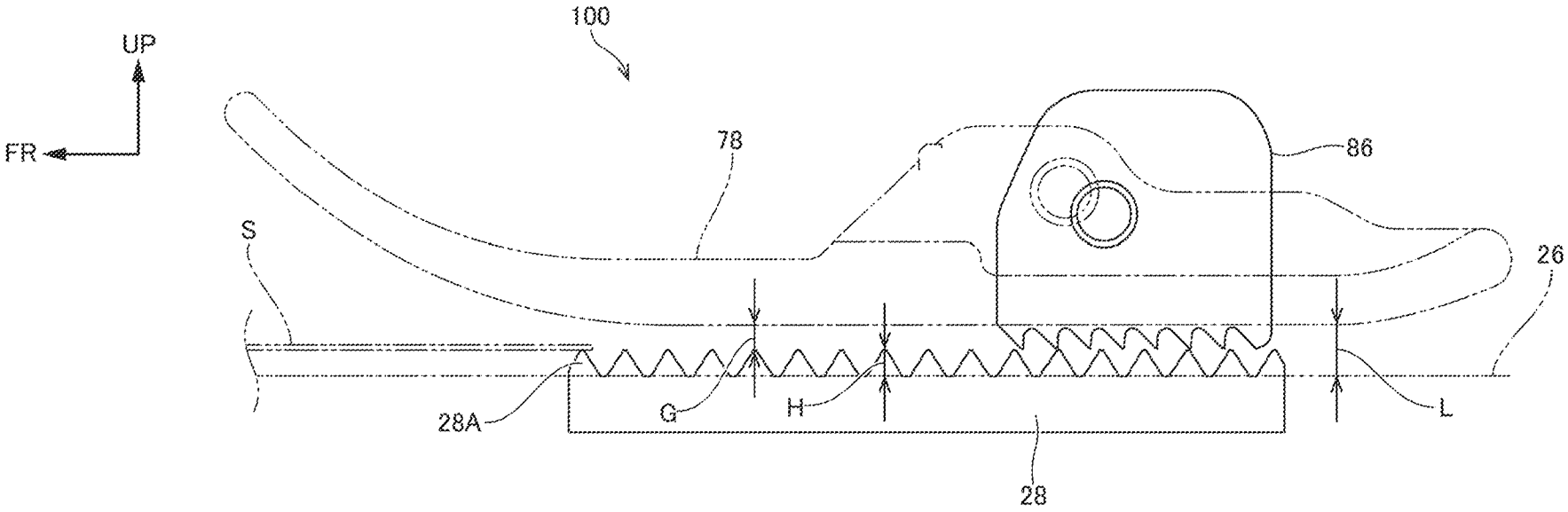
FIG. 1B is a side view as viewed from the right side for explaining the start of a feeding operation of a sewing machine for a sewing target according to a comparison example.

Description will be made below with reference to the drawings regarding a sewing machine 10 according to the present embodiment. It should be noted that, in the drawings, the arrow UP shown as appropriate indicates the upper side of the sewing machine 10, the arrow FR indicates the front side of the sewing machine 10, and the arrow RH indicates the right side (one side in the width direction). The directions used in the following description, i.e., the upper-lower direction, the front-back direction, and the left-right direction, represent the upper and lower, front and back, and left and right directions of the sewing machine 10.

Figure 2:
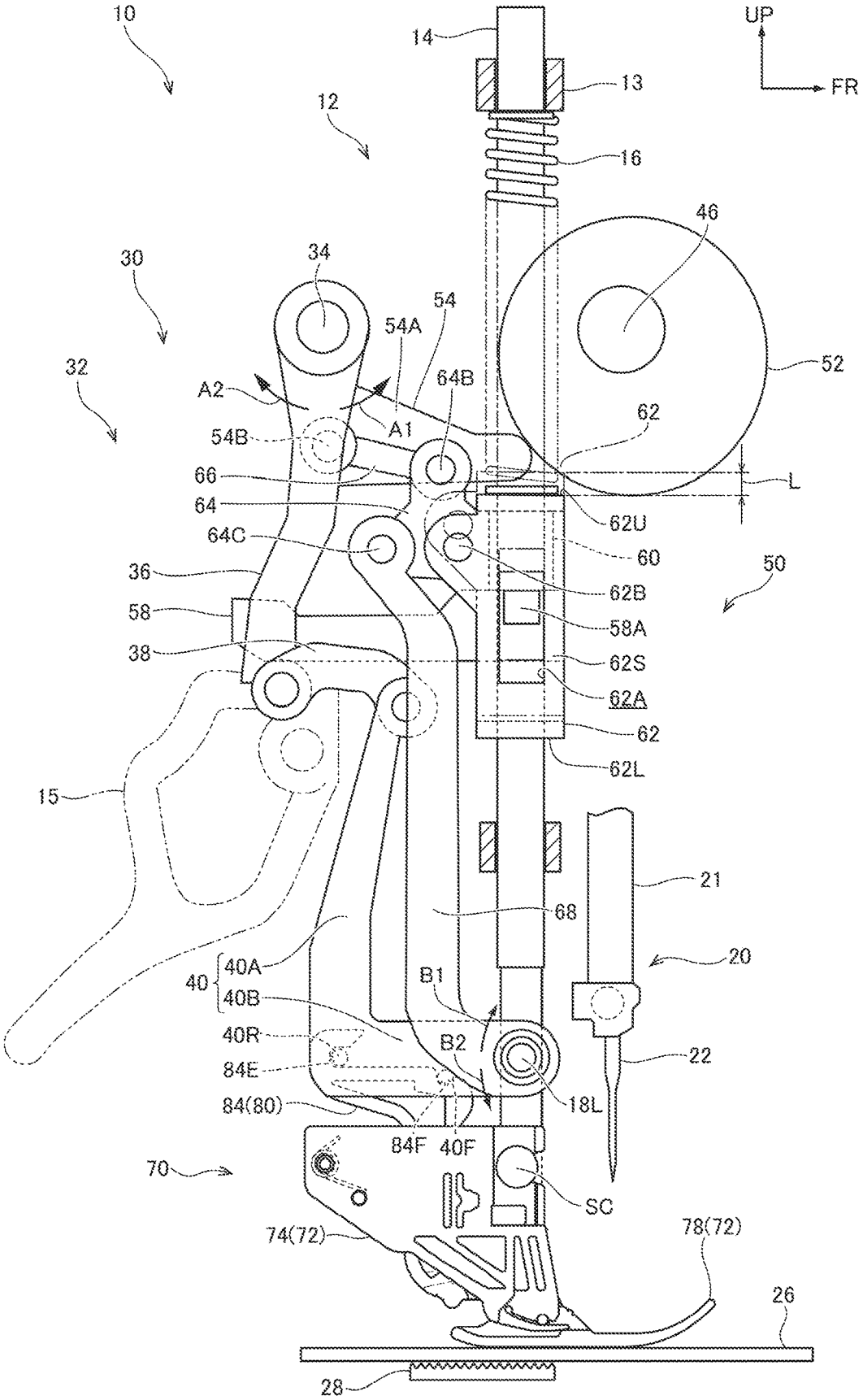
FIG. 2 is a side view as viewed from the left side showing main components of the sewing machine according to the present embodiment.
Figure 3:
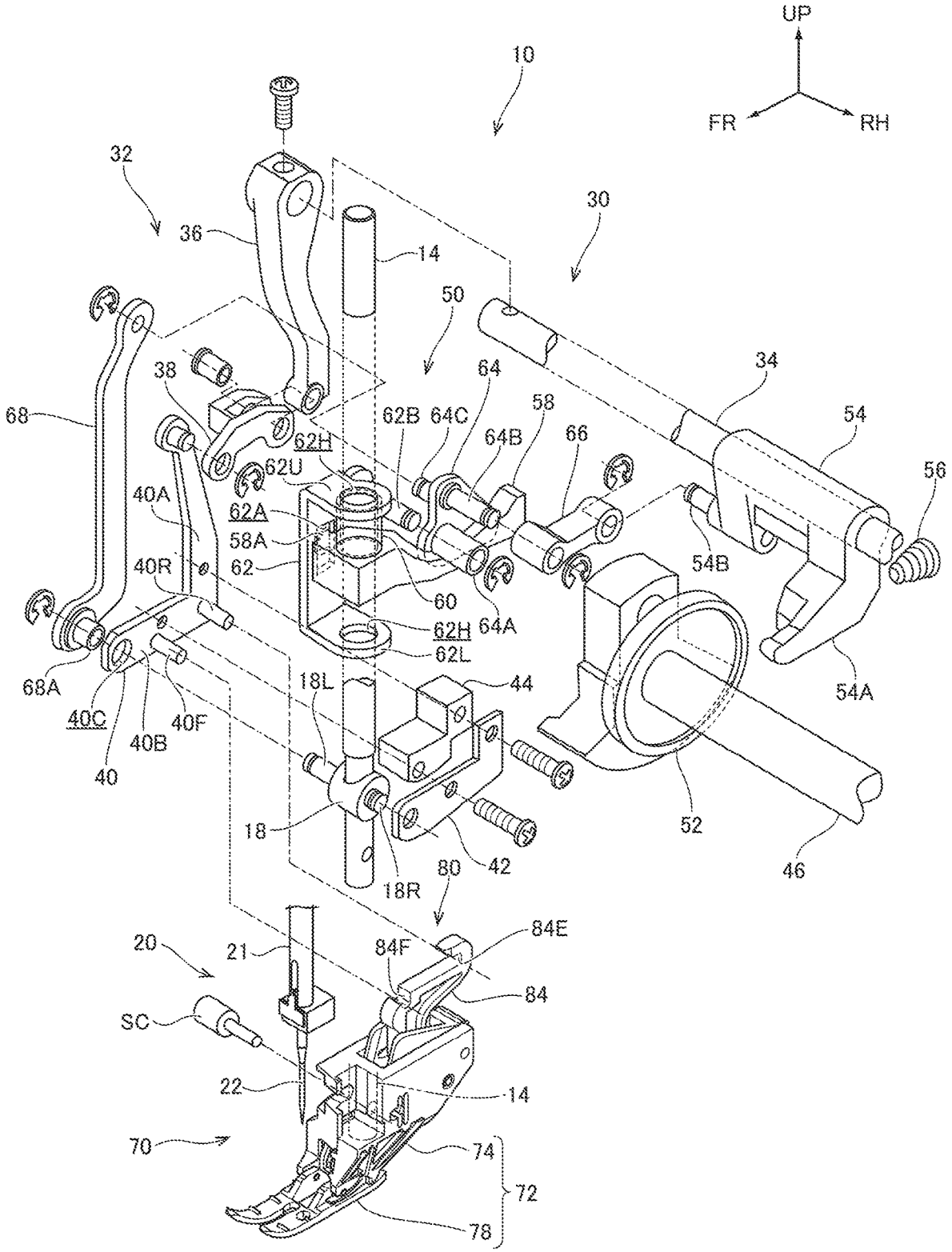
FIG. 3 is an exploded perspective view showing the main components of the sewing machine shown in FIG. 2 in a state in which they are disassembled.

As shown in FIGS. 2 and 3, the sewing machine 10 has a configuration including a sewing machine main body 12, a presser unit 70 that presses a sewing target from the upper side, and an upper feed driving mechanism 30 configured to drive the presser unit 70. Description will be made below regarding each component of the sewing machine 10.

Regarding the Sewing Machine Main Body

The sewing machine main body 12 includes a presser bar 14. The presser bar 14 is formed in an approximately round-bar shape with the upper-lower direction as its axial direction. The presser bar 14 is supported by a frame 13 that forms the sewing machine main body 12 such that it can be relatively moved in the upper-lower direction. Furthermore, a presser bar holder 58 that forms a spring presser release mechanism 50 described later is fixed to an intermediate portion of the presser bar 14 in the upper-lower direction. Furthermore, the sewing machine main body 12 includes an operating lever 15, which is to be used for replacement of a presser unit 70 or the like described later. The operating lever 15 is rotatably coupled to the frame 13 with the left-right direction as its axial direction on the rear side of the presser bar 14 described later and on the lower side of the presser bar holder 58. With such an arrangement, the presser bar holder 58 is supported from the lower side by the operating lever 15, which defines the position of the presser bar 14 in the upper-lower direction. Furthermore, in the replacement of the presser unit 70 or the like described later, by operating to turn the operating lever 15 upward from the position shown in FIG. 2, this arrangement allows the operating lever 15 to lift the presser bar holder 58, thereby moving the presser bar 14 upward.

A presser spring 16 is mounted on an upper portion of the presser bar 14. The presser spring 16 is configured as a compression coil spring. An upper end portion of the presser spring 16 is engaged with the frame 13.

A lower end portion of the presser bar 14 is provided with a coupling member 18 configured to couple an upper feed driving mechanism 30 described later to the presser bar 14. The coupling member 18 is formed in an approximately cylindrical shape with the left-right direction as its axial direction. Furthermore, the lower end portion of the presser bar 14 is inserted into an intermediate portion in the axial direction of the coupling member 18 such that the lower end portion of the presser bar 14 can be relatively moved in the upper-lower direction. The coupling member 18 is provided with a pair of left and right support shafts 18L and 18R. The support shafts 18L and 18R are configured such that they protrude outward from the coupling member 18 with the left-right direction as its axial direction, and are arranged coaxially.

Furthermore, the sewing machine main body 12 includes a needle mechanism 20. The needle mechanism 20 includes a needle bar 21. The needle bar 21 is arranged on the front side of the presser bar 14 such that it extends in the upper-lower direction. Furthermore, a sewing needle 22 configured as a "needle" is fixed to a lower end portion of the needle bar 21. With such an arrangement, in the operating of the sewing machine 10, the needle bar 21 moves reciprocally (reverses) in the upper-lower direction, which allows the sewing needle 22 to perform sewing of the sewing target. Furthermore, a needle plate 26 (see FIG. 2) is arranged on the lower side of the needle mechanism 20. The needle plate 26 is formed in an approximately rectangular shape with the upper-lower direction as its thickness direction. The needle plate 26 is fixed to the sewing machine main body 12.

Figure 4A:
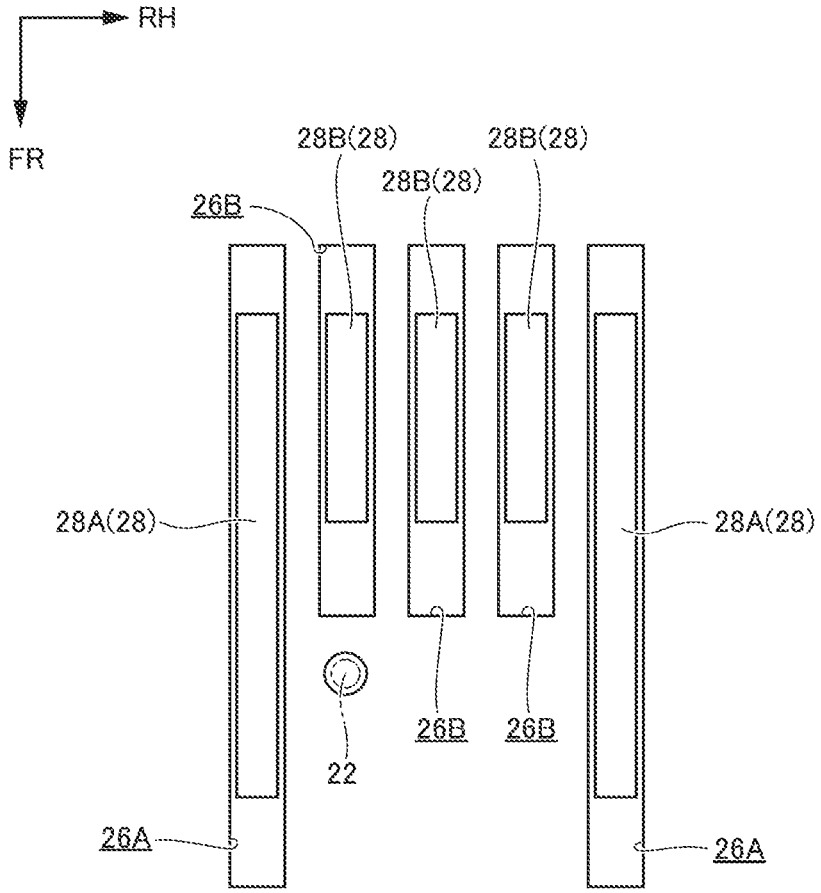
FIG. 4A is a plan view as viewed from the upper side showing tooth portions of a lower feed dog shown in FIG. 2.

A lower feed dog 28 (see FIG. 2) that forms the lower feed mechanism is arranged on the lower side of the needle plate 26. As shown in FIG. 4A, multiple (five, in the present embodiment) tooth portions are formed at the upper end portion of the lower feed dog 28 such that they each extend in the front-back direction and such that they are arranged in the left-right direction. Specifically, the lower feed dog 28 includes a pair of left and right first tooth portions 28A and three second tooth portions 28B arranged between the pair of first tooth portions 28A. In a plan view as viewed from the upper side, the first tooth portions 28A are respectively arranged on the left side and the right side of the sewing needle 22. Furthermore, the first tooth portions 28A are designed to have a length in the front-back direction such that the front ends of the first tooth portions 28A are arranged further on the front side than the sewing needle 22, and such that the rear ends of the first tooth portions 28A are arranged further on the rear side than the needle location position of the sewing needle 22. On the other hand, as viewed from the plan view, the second tooth portions 28B are arranged further on the rear side than the needle location position of the sewing needle 22. Furthermore, the position of the rear end of each of the second tooth portions 28B matches the position of the rear end of each first tooth portion 28B in the front-back direction. That is to say, the second tooth portions 28B are each designed to have a front-back direction length that is smaller than the front-back direction length of each first tooth portion 28A. Furthermore, multiple teeth are formed on the upper face of each of the first tooth portions 28A and the second tooth portions 28B such that they are arranged in the front-back direction. It should be noted that the needle plate 26 is configured to have first exposure openings 26A formed so as to expose the first tooth portions 28A and second exposure openings 26B formed so as to expose the second tooth portions 28B.

Regarding the Upper Feed Driving Mechanism

As shown in FIGS. 2 and 3, the upper feed driving mechanism 30 is configured including a feed driving mechanism unit 32 that functions as a "feed driving unit" configured to drive the upper feed driving mechanism 80 of the presser unit 70 described later, and a spring presser release mechanism 50 configured to release the force applied by the presser spring 16 to the presser bar 14.

Regarding the Feed Driving Mechanism Unit

The feed driving mechanism unit 32 is configured including a feed shaft 34, a first feed arm 36, and a second feed arm 40.

The feed shaft 34 is formed in an approximately round-bar shape with the left-right direction as its axial direction. The feed shaft 34 is coupled to a lower feed mechanism (not shown) so as to operate together with the operation of the lower feed mechanism, which turns the feed shaft 34 around its axis.

The first feed arm 36 is configured to have an approximately longitudinal block structure with an approximately upper-lower direction as its longitudinal direction. The upper end portion of the first feed arm 36 is fixed to a left end portion of the feed shaft 34 such that they can be turned as a single unit. On the other hand, the lower end portion of the first feed arm 36 is coupled to the rear end portion of a feed link 38 arranged to extend in an approximately front-back direction, such that it can be turned with the left-right direction as its axial direction.

The second feed arm 40 is arranged on a diagonally lower-front side of the first feed arm 36. In a side view as viewed from the left side, the second feed arm 40 is configured to have an approximately L-shaped structure. Specifically, the second feed arm 40 is configured including an arm main body portion 40A configured such that it extends in the upper-lower direction, and an arm coupling portion 40B configured such that it extends toward the front side from the lower end portion of the arm main body portion 40A. With such an arrangement, the upper end portion of the arm main body portion 40A is coupled to the front end portion of the feed link 38 such that it can be turned with the left-right direction as its axial direction. Furthermore, a circular coupling opening 40C is formed as a through hole in the front end portion of the arm coupling portion 40B. The coupling opening 40C is coupled to the support shaft 18L configured as a left side portion of the coupling member 18 via a switching arm 68 described later such that the second feed arm 40 can be turned. With this arrangement, by turning the feed shaft 34 around its axis, the second feed arm 40 is turned around the axis of the support shaft 18L.

Furthermore, an auxiliary plate 42 is arranged on the right side of the above-described coupling member 18. The auxiliary plate 42 is arranged with the left-right direction as its thickness direction. Furthermore, in a side view as viewed from the left side, the auxiliary plate 42 is configured in an approximately L-shaped structure. With such an arrangement, the front end portion of the auxiliary plate 42 is supported by the support shaft 18R configured as a right side portion of the coupling member 18 such that it can be turned. Furthermore, a spacer 44 is arranged on the rear side of the coupling member 18 (more specifically, between the second feed arm 40 and the auxiliary plate 42). In the side view as viewed from the left side, the spacer 44 is configured to have an approximately L-shaped block structure. With such an arrangement, the auxiliary plate 42 is fixed to the second feed arm 40 via the spacer 44 by fastening using a pair of screws.

Furthermore, the second feed arm 40 (arm coupling portion 40B thereof) is provided with a pair of front and rear coupling shafts 40F and 40R configured to couple a upper feed mechanism 80 (upper feed foot 84) described later. The coupling shafts 40F and 40R are each configured such that they protrude toward the right side from the arm coupling portion 40B with the left-right direction as their axis directions.

Regarding the Spring Presser Release Mechanism

The spring presser release mechanism 50 is configured including a cam 52, a driven lever 54, a presser bar holder 58, a spring receiver 60, a presser spring holder 62 configured as a "transmission member", a bell crank 64, and a switching arm 68.

The cam 52 is arranged on the front side of the feed shaft 34. The cam 52 is configured as an approximately disc-shaped plate cam with the left-right direction as its thickness direction. The cam 52 is configured with its outer circumferential face as a cam face. The cam 52 is fixed to the upper shaft 46 arranged with the left-right direction as its axial direction such that they can be turned as a single unit. The upper shaft 46 is arranged at a position with an offset with respect to the center of the cam 52.

In this arrangement, the upper shaft 46 is also configured as a shaft to drive the above-described needle mechanism 20. The upper end portion of the needle bar 21 is coupled to the left-side end portion of the upper shaft 46 via an unshown crank mechanism. Furthermore, the upper shaft 46 is coupled to a lower shaft (not shown) configured to drive a lower feed mechanism (lower feed dog 28). By turning the lower shaft, this arrangement allows the lower feed dog 28 to be driven in the front-back direction and in the upper-lower direction. With such an arrangement, in the driving operation of the lower feed dog 28, the first tooth portions 28A and the second tooth portions 28B of the lower feed dog 28 are set such that they protrude further upward than the upper face of the needle plate 26. In this state, the sewing target is fed backward by the lower feed dog 28 together with an upper feed dog 86 described later.

The driven lever 54 is supported by the above-described feed shaft 34 such that it can be turned (swung), and is arranged on the rear side of the cam 52. A lever portion 54A is provided at a right end portion of the driven lever 54. The lever portion 54A is configured such that it protrudes from the driven lever 54 toward the front side (cam 52 side). With such an arrangement, a force-applying spring 56 applies a force to the driven lever 54 toward the front side (cam 52 side). In this state, the end portion of the lever portion 54A comes in contact with the cam face of the cam 52. With this arrangement, by turning the cam 52, the driven lever 54 is swung around the axis of the feed shaft 34 according to the shape of the cam face. Furthermore, a driven-side coupling shaft 54B is monolithically provided to the left end portion of the driven lever 54 in order to couple the bell crank 64 described later to the driven lever 54. The driven-side coupling shaft 54B is arranged on the lower side of the feed shaft 34 with the left-right direction as its axial direction.

The presser bar holder 58 is configured in an approximately rectangular block shape extending in the front-back direction. Furthermore, a front end portion of the presser bar holder 58 is fixed to an intermediate portion along the longitudinal direction of the presser bar 14. A rear end portion of the presser bar holder 58 is supported from the lower side by the above-described operating lever 15. Furthermore, a protrusion 58A is formed on the left-side face of the front end portion of the presser bar holder 58. The protrusion 58A is configured in an approximately rectangular block shape protruding toward the left side from the presser bar holder 58.

The spring receiver 60 is configured in an approximately cylindrical shape with the upper-lower direction as its axial direction. Furthermore, the presser bar 14 is inserted into the interior of the spring receiver such that it can be relatively moved. The spring receiver 60 is arranged adjacent to the upper side of the front end portion of the presser bar holder 58.

In a front view as viewed from the front side, the presser spring holder 62 is formed in an approximately U-shaped structure having an opening facing the right side. Specifically, the presser spring holder 62 includes a side wall 62S extending in the upper-lower direction with the left-right direction as its thickness direction, an upper wall 62U extending from the upper end portion of the side wall 62S toward the right side, and a lower wall 62L extending from the lower end portion thereof toward the right side. Furthermore, a circular insertion opening 62H is formed as a through hole in each of the upper wall 62U and the lower wall 62L. With such an arrangement, the presser bar 14 is inserted into the insertion openings 62H of the presser spring holder 62 such that it can be relatively moved in the upper-lower direction in a state in which the front end portion of the presser bar holder 58 and the spring receiver 60 are arranged within the presser spring holder 62 (between the upper wall 62U and the lower wall 62L). In other words, the presser spring holder 62 is supported by the presser bar 14 such that it can be relatively moved. Furthermore, the upper wall 62U of the presser spring holder 62 supports the lower end portion of the presser spring 16 from the lower side (see FIG. 2). The presser spring holder 62 is forced downward by the force applied by the presser spring 16. In this state, the upper end of the spring receiver 60 is pressed in contact with the upper wall 62U of the presser spring holder 62. As a result, the force applied by the presser spring 16 is transmitted to the presser bar 14 via the upper wall 62U of the presser spring holder 62, the spring receiver 60, and the presser bar holder 58 (in the description below, the position of the presser spring holder 62 with respect to the presser bar 14 in a state in which the upper wall 62U of the presser spring holder 62 comes in contact with the upper end of the spring receiver 60 will be referred to as the "transmission position"). It should be noted that the lower wall 62L of the presser spring holder 62 is arranged on the lower side with an offset with respect to the presser bar holder 58.

Furthermore, a slot 62A is formed as a through hole in the side wall 62S of the presser spring holder 62. The slot 62A is configured in an approximately rectangular shape with the upper-lower direction as its longitudinal direction. With such an arrangement, the protrusion 58A of the presser bar holder 58 described above is inserted into the slot 62A such that it can be relatively moved in the upper-lower direction. With this arrangement, the presser spring holder 62 is configured such that it can be relatively moved in the upper-lower direction in a predetermined range with respect to the presser bar holder 58 (presser bar 14).

Furthermore, a switching shaft 62B is provided to the side wall 62S of the presser spring holder 62 such that it is positioned on the rear side of the slot 62A. The switching shaft 62B is formed in an approximately cylindrical shape with the left-right direction as its axial direction. Furthermore, the switching shaft 62B is configured such that it protrudes from the side wall 62S toward the right side at a position on the rear side of the presser bar 14.

When the spring presser release mechanism 50 is operated, the presser spring holder 62 is relatively moved upward with respect to the presser bar 14 from the transmission position against the force applied by the presser spring 16, and is set to the release position (in FIG. 2, the position of the presser spring holder 62 indicated by the line of alternately long and two short dashes), detailed description of which will be made later. With such an arrangement, at the release position, the upper wall 62U of the presser spring holder 62 is offset upward from the spring receiver 60. Accordingly, the force applied to the presser bar 14 by the presser spring 16 is released. Furthermore, in the present embodiment, the (maximum) relative movement amount L (distance between the transmission position and the release position in the upper-lower direction) of the presser spring holder 62 with respect to the presser bar 14 to be set when the spring presser release mechanism 50 is operated is designed to be the same as the (maximum) protrusion height H (see FIG. 1A and FIG. 8B) from the upper face of the needle plate 26 of the lower feed dog 28 (first tooth portions 28A and second tooth portions 28B).

The bell crank 64 is configured in an approximately triangular plate shape with the left-right direction as its thickness direction. The bell crank 64 is arranged on the rear side of the presser spring holder 62 and on the front side of the driven-side coupling shaft 54B of the driven lever 54. A coupling cylinder portion 64A configured in an approximately cylindrical shape protruding toward the right side is provided to the lower end portion of the bell crank 64. The switching shaft 62B of the presser spring holder 62 is rotatably inserted into the coupling cylinder portion 64A. Furthermore, a first coupling shaft 64B protruding toward the right side is provided to the upper end portion of the bell crank 64. A front end portion of a coupling link 66 extending in the front-back direction is rotatably coupled to the first coupling shaft 64B. The rear end portion of the coupling link 66 is rotatably coupled to the driven-side coupling shaft 54B of the driven lever 54. With this arrangement, the bell crank 64 and the driven lever 54 are coupled via the coupling link 66. With such an arrangement, upon turning the cam 52, the driven lever 54 is swung according to the shape of the cam face of the cam 52, thereby operating the bell crank 64 (i.e., the spring presser release mechanism 50). Furthermore, the bell crank 64 is provided with a second coupling shaft 64C configured to couple the bell crank 64 to the switching arm 68 described later. The second coupling shaft 64C is configured on the rear side of the coupling cylinder portion 64A such that it protrudes from the bell crank 64 toward the left side.

The switching arm 68 is configured on the left side of the second feed arm 40 such that it extends in the upper-lower direction in an approximately longitudinal plate structure with the left-right direction as its thickness direction. A coupling cylinder portion 68A having an approximately cylindrical shape protruding toward the right side is monolithically formed in the lower end portion of the switching arm 68. The coupling cylinder portion 68A is inserted into the coupling opening 40C of the second feed arm 40 so as to rotatably support the lower end portion of the second feed arm 40. Furthermore, the support shaft 18L configured as a left-side portion of the coupling member 18 described above is inserted into the coupling cylinder portion 68A, such that the coupling cylinder portion 68A is rotatably supported by the support shaft 18L. On the other hand, the upper end portion of the switching arm 68 is rotatably coupled to the second coupling shaft 64C of the bell crank 64.

Regarding the Presser Unit

Figure 5A:
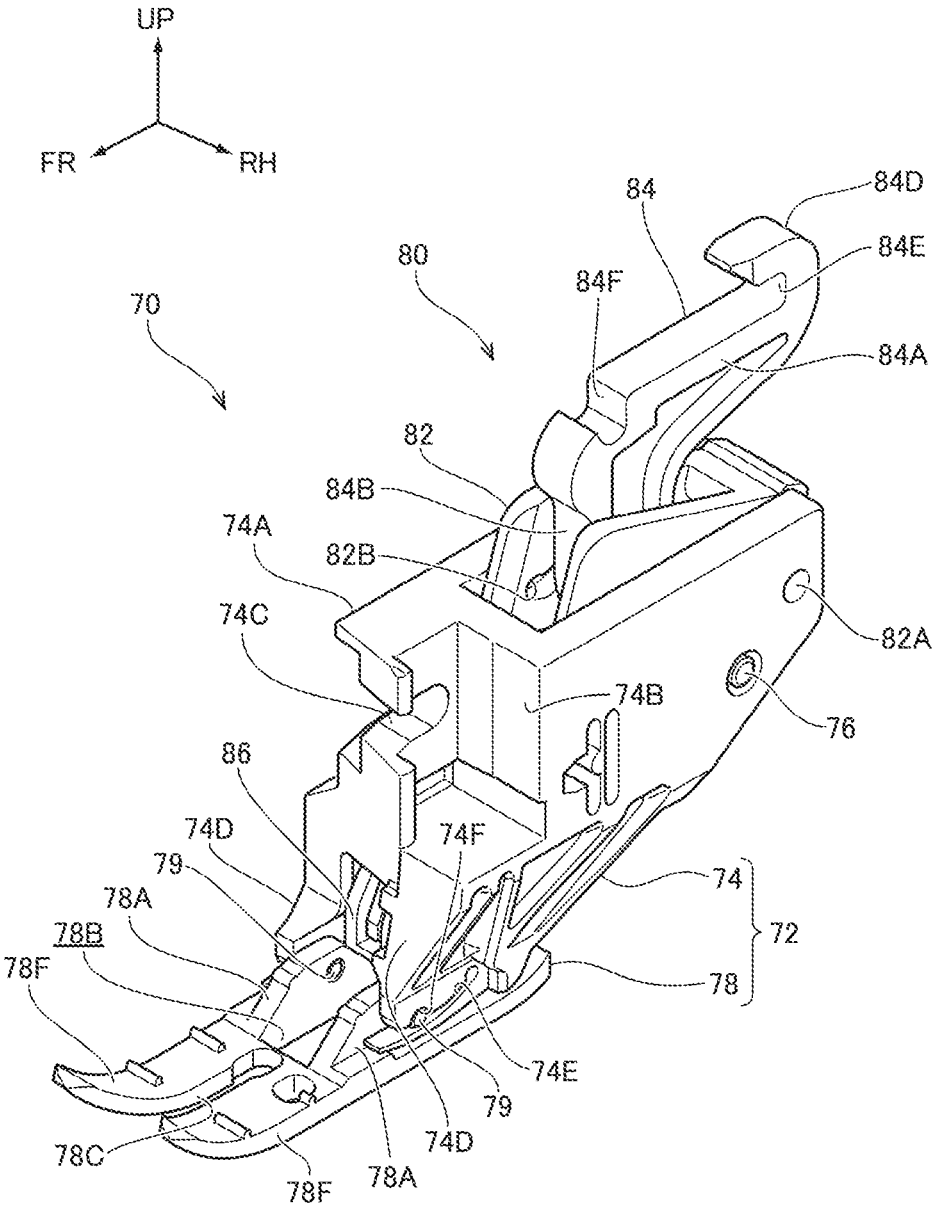
FIG. 5A is a perspective view showing the overall structure of a feed unit shown in FIG. 2.
Figure 5B:
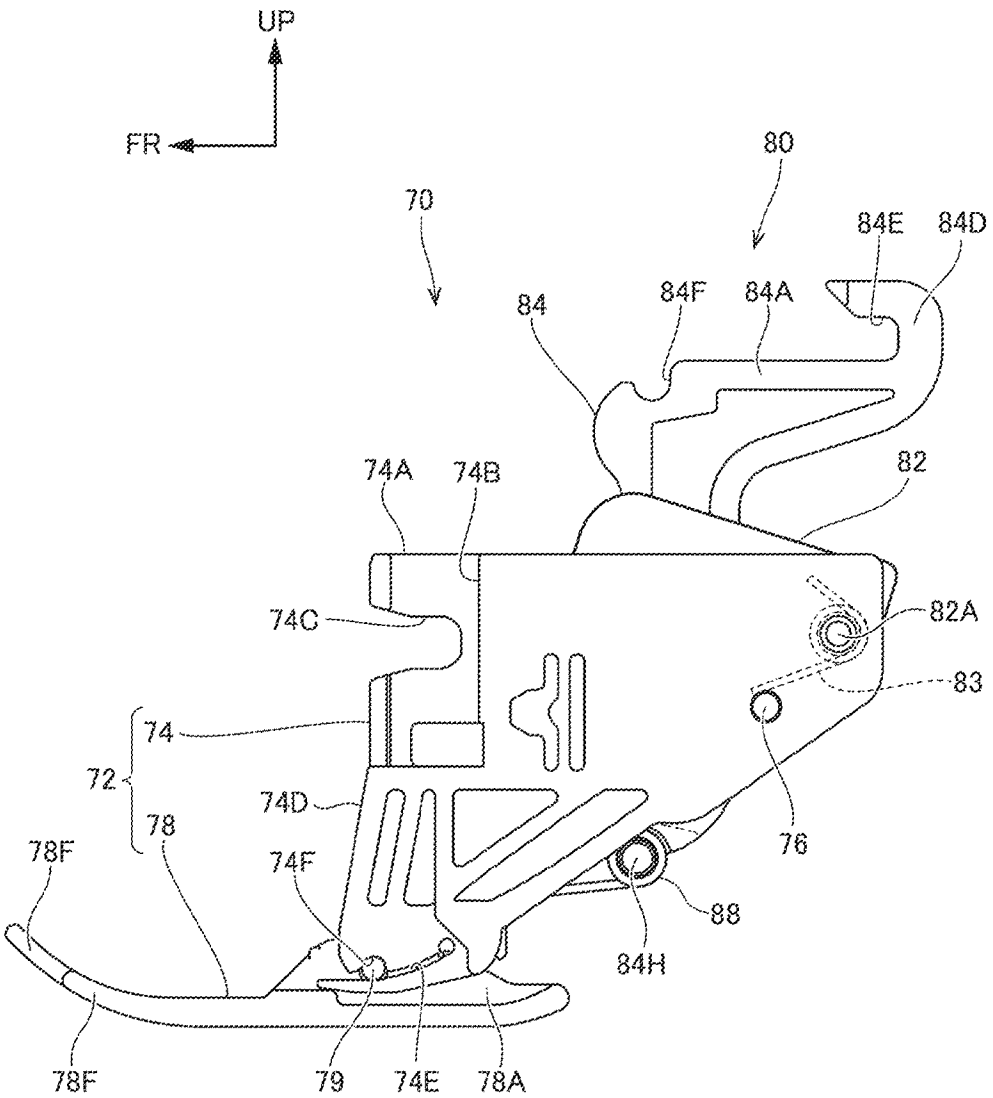
FIG. 5B is a side view as viewed from the right side showing the feed unit shown in FIG. 5A.
Figure 6:
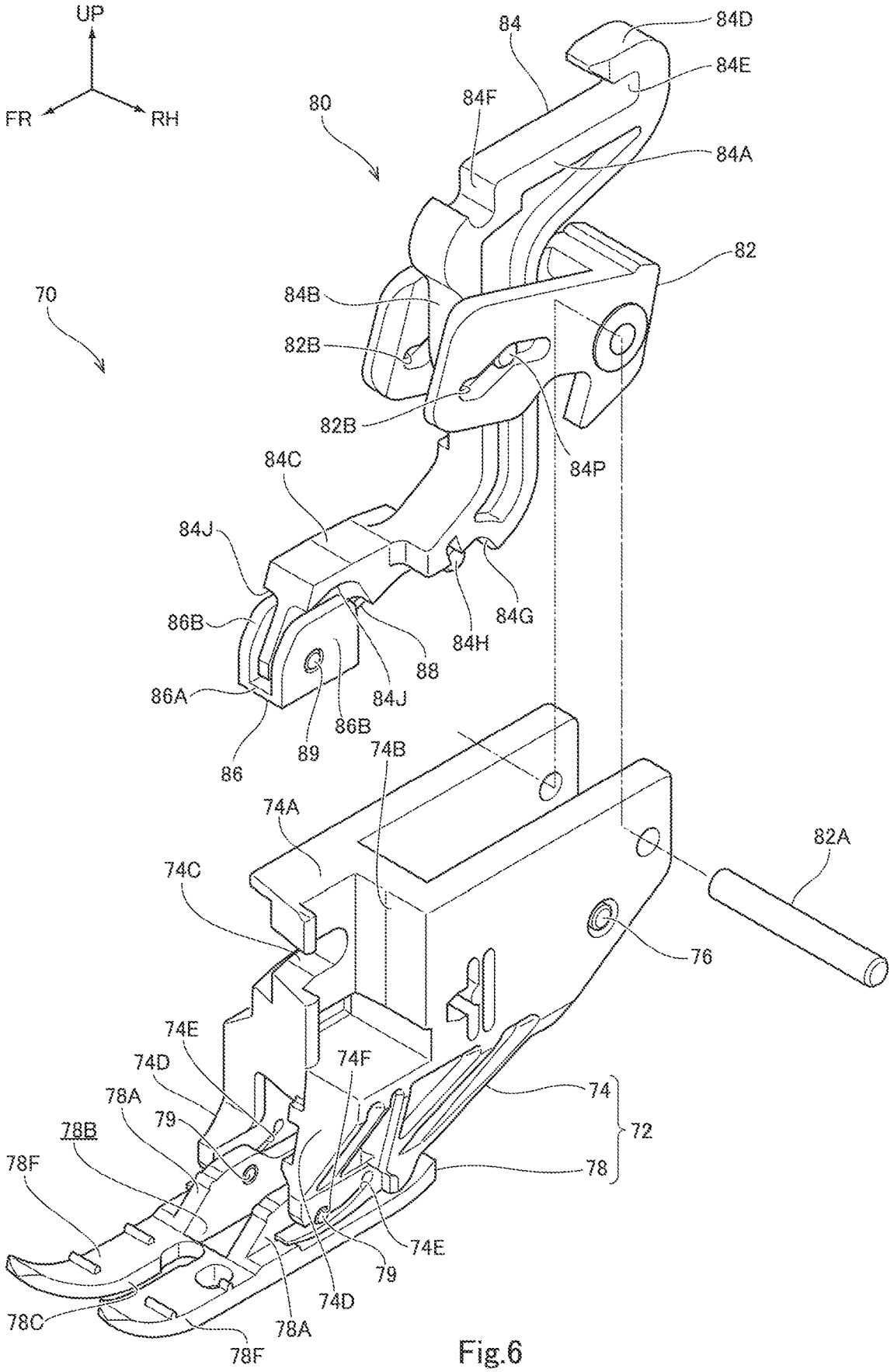
FIG. 6 is an exploded perspective view showing the upper feed mechanism shown in FIG. 5 detached from the a presser main body.
Figure 7A:
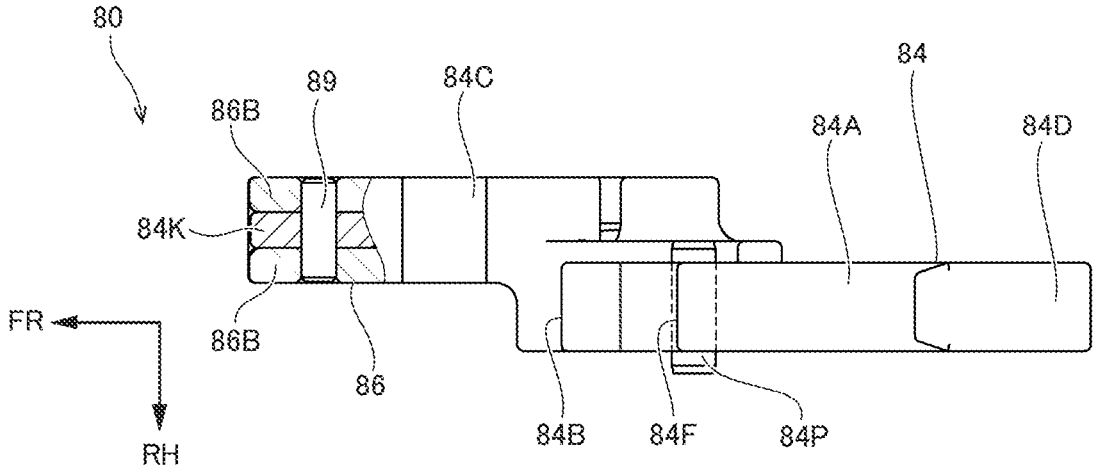
FIG. 7A is a plan view showing the upper feed mechanism shown in FIG. 6 in a state in which a feed foot supporting member is detached.
Figure 7B:
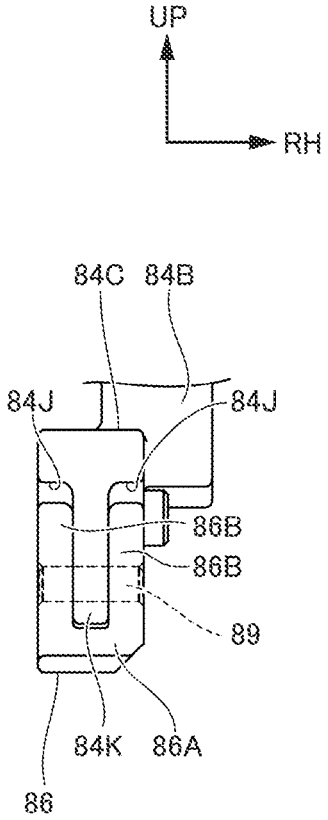
FIG. 7B is a front view as viewed from the front side showing a lower end portion of the upper feed mechanism shown in FIG. 7A.
Figure 7C:
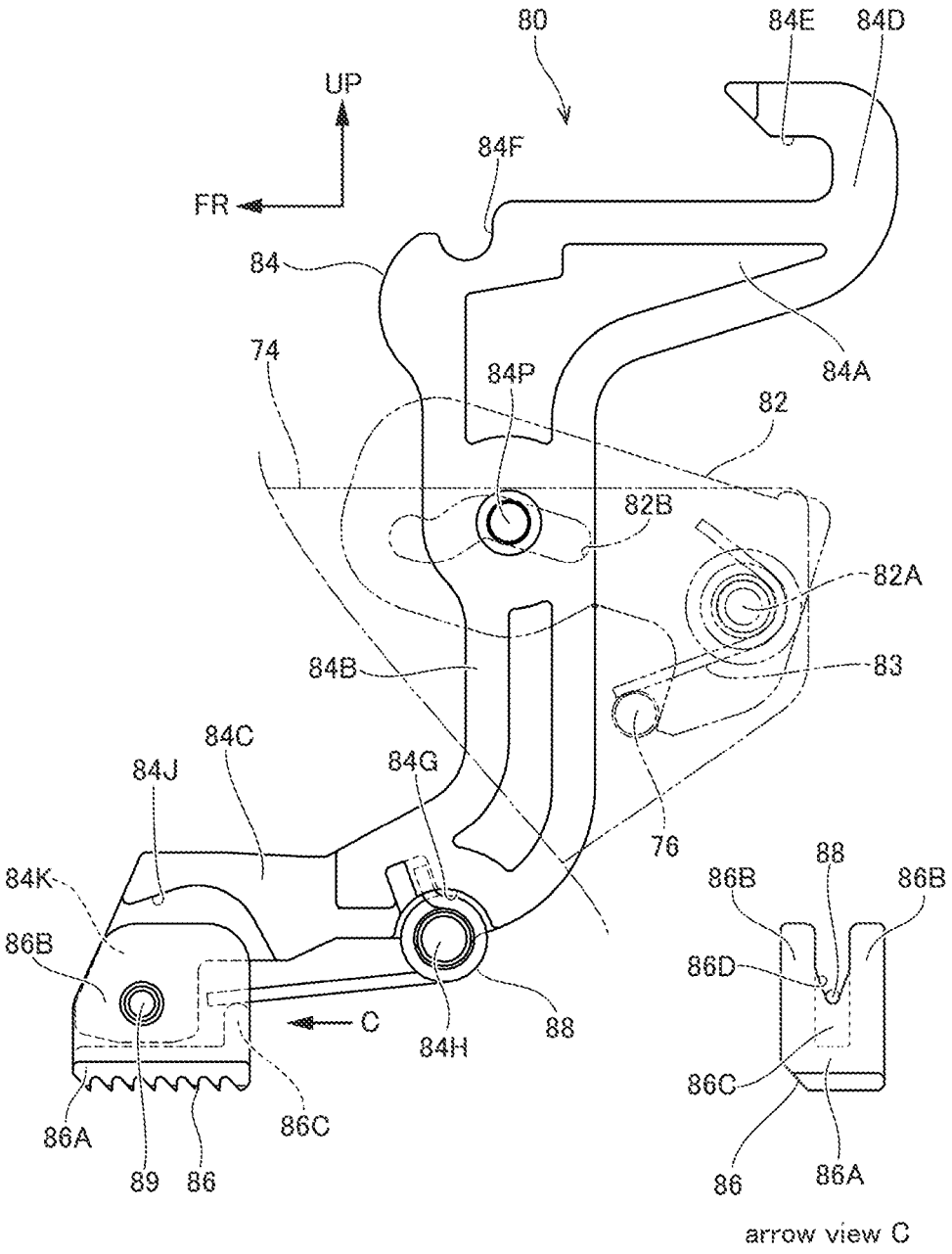
FIG. 7C is a side view as viewed from the right side showing the upper feed mechanism shown in FIG. 7A.

As shown in FIGS. 5 through 7, the presser unit 70 is configured including a presser main body 72 configured to press the sewing target from the upper side, and an upper feed mechanism 80 configured to feed the sewing target toward the rear side together with the lower feed dog 28 described above. With such an arrangement, the upper feed mechanism 80 is coupled to the presser main body 72 such that the presser main body 72 and the upper feed mechanism are combined in the form of a single unit, i.e., the presser unit 70.

Regarding the Presser Main Body

The presser main body 72 includes a presser holder 74 and a presser tab 78 configured as a "presser".

In a plan view as viewed from the upper side, the presser holder 74 is configured to have an approximately U-shaped overall structure having an opening facing the rear side. The front end portion of the presser holder 74 is configured as a holder coupling portion 74A as a "presser fixing portion". A presser bar mounting portion 74B is formed in the upper portion of the holder coupling portion 74A. In a plan view, the presser bar mounting portion 74B is formed in the form of a recess facing the front side and the right side. With such an arrangement, the lower end portion of the presser bar 14 is arranged within the presser bar mounting portion 74B (see FIG. 3).

Furthermore, a fixing groove 74C is formed such that it passes through in the left-right direction in a left-side portion of the presser bar mounting portion 74B. In a side view, the fixing groove 74C is configured in an approximately U-shaped structure having an opening facing the front side. With such an arrangement, a fixing screw SC (see FIG. 3) is inserted from the left side into the fixing groove 74C such that the presser holder 74 (holder coupling portion 74A) is fixedly fastened to the presser bar 14 by the fixing screw SC. With this arrangement, the presser holder 74 (presser main body 72) is detachably fixed to the presser bar 14.

A pair of left and right presser mounting portions 74D configured to mount the presser tab 78 described later are monolithically formed in the lower end portion of the holder coupling portion 74A. The presser mounting portions 74D are configured such that they respectively extend toward the lower side from both ends of the lower end portion of the holder coupling portion 74A in the width direction. Furthermore, a presser mounting groove 74E having an opening facing the front side is formed in the lower end portions of the presser mounting portions 74D. The presser mounting groove 74E is configured such that it extends in an approximately front-back direction and such that it passes through in the left-right direction. Furthermore, a mounting recess portion 74F is formed in the upper-side inner circumferential face of the presser mounting groove 74E with an opening formed facing the lower side, which allows a mounting pin 79 for mounting the presser tab 78 described later to be inserted into the mounting recess portion 74F. Furthermore, a first pin 76 is provided to a rear portion of the presser holder 74 with the left-right direction as its axial direction. The first pin 76 is arranged such that it is supported by the left and right side walls of the presser holder 74.

Figure 4B:
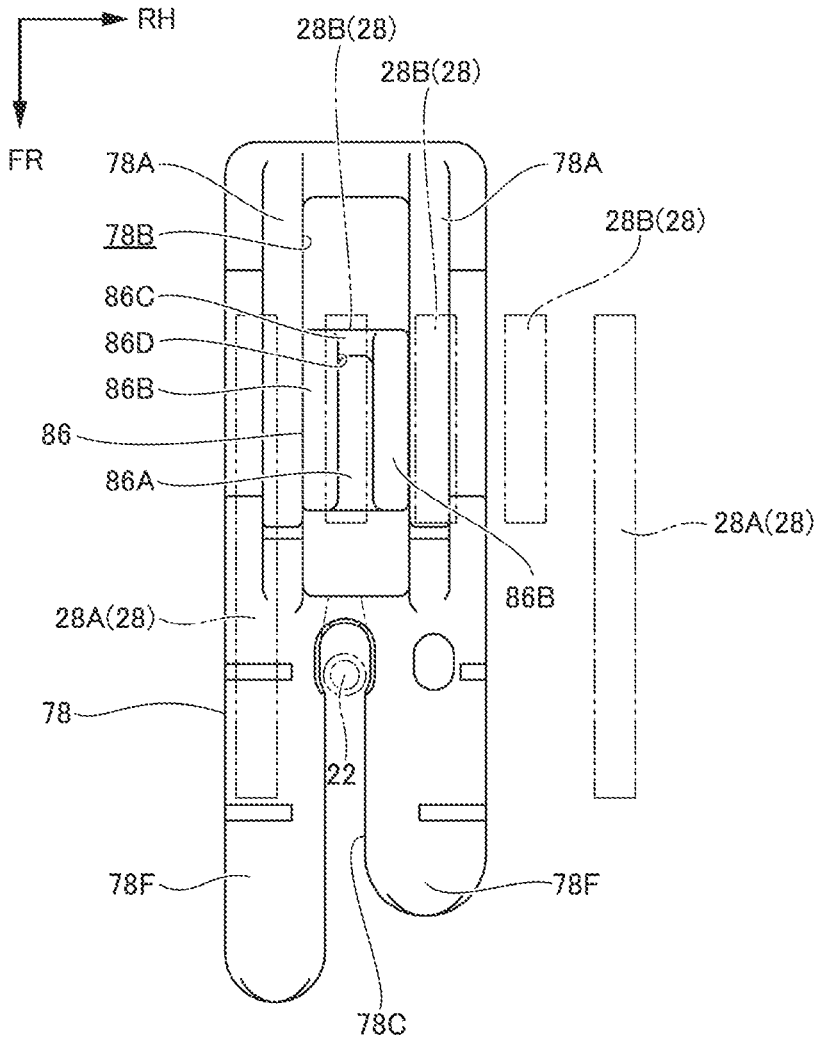
FIG. 4B is a plan view for explaining the position relation in the left-right direction between tooth portions of the lower feed dog shown in FIG. 4A, a presser tab, and an upper feed dog.

As also shown in FIG. 4B, the presser tab 78 is configured in an approximately rectangular plate shape with an approximately upper-lower direction as its thickness direction and with the front-back direction as its longitudinal direction. In a side view, the presser tab 78 has a front end portion that smoothly curves upward as it becomes closer to the front side. A pair of left and right mounting walls 78A are monolithically formed in a rear portion of the presser tab 78. The mounting walls 78A are each configured such that they protrude upward from the presser tab 78 with the left-right direction as their thickness direction, and are arranged between the pair of presser mounting portions 74D of the presser holder 74. The mounting pin 79 is provided to the pair of mounting walls 78A. The mounting pin 79 is configured in an approximately cylindrical shape with the left-right direction as its axial direction. The mounting pin 79 is arranged such that it protrudes outward from the pair of mounting walls 78A along the width direction of the presser tab 78. With such an arrangement, the mounting pin 79 is inserted into the mounting groove 74E of the presser holder 74 from the front side, and is inserted into the mounting recess portion 74F of the presser mounting groove 74E, thereby rotatably mounting the presser tab 78 on the presser holder 74.

Furthermore, an insertion opening 78B is formed in a rear portion of the presser tab 78 such that it is positioned between the pair of left and right mounting walls 78A. In a plan view, the insertion opening 78B is configured in an approximately rectangular shape with the front-back direction as its longitudinal direction. Furthermore, a groove portion 78C having an opening facing the front side is formed in a front portion of the presser tab 78 such that it is positioned at an intermediate portion thereof along its width direction. The groove portion 78C is configured such that it extends in the front-back direction and such that it passes through in the upper-lower direction. With this arrangement, the front portion of the presser tab 78 is configured as a pair of left and right front presser portions 78F divided by the groove portion 78C.

Here, as shown in FIG. 4B, the presser tab 78 is designed to have a width-direction size that is smaller than the width size of the lower feed dog 28 (specifically, the distance between the outer side faces of the pair of first tooth portions 28A in the width direction). Furthermore, the presser tab 78 is arranged closer to the left side than the central portion in the width direction of the lower feed dog 28. Specifically, in a plan view, the presser tab 78 is designed to have a width size such that the presser tab 78 overlaps the left-side first tooth portion 28A and the second tooth portions 28B at two positions, i.e., the left-side and central second tooth positions 28B, in the width direction of the lower feed dog 28. More specifically, in a plan view, the left-side front presser portion 78F of the presser tab 78 is arranged such that it overlaps the left-side first tooth portion 28A of the lower feed dog 28. Furthermore, the central second tooth portion 28B in the width direction of the lower feed dog 28 is arranged on the rear side of the right-side front presser portion 78F in the presser tab 78. Moreover, in a plan view, the presser tab 78 is designed such that its insertion opening 78B overlaps the left-side second tooth portion 28B of the lower feed dog 28. In addition, the present embodiment is configured such that the sewing needle 22 can be moved in the left-right direction. With such an arrangement, in a plan view, when the sewing operation is performed for a sewing target using the presser unit 70, the sewing needle 22 is arranged closer to the left side such that the sewing needle 22 is arranged at a position that matches the groove portion 78C of the presser tab 78.

Regarding the Upper Feed Mechanism

As shown in FIGS. 5 through 7, the upper feed mechanism 80 is configured including a feed foot supporting member 82, an upper feed foot 84 configured as an "upper feed holder", an upper feed dog 86, and a feed dog force-applying spring 88.

In a plan view, the feed foot supporting member 82 is configured in an approximately U-shaped structure having an opening facing the front side. The feed foot supporting member 82 is arranged within the presser holder 74 and on the upper side of the first pin 76. Furthermore, the rear portion of the feed foot supporting member 82 is rotatably supported by a second pin 82A arranged with the left-right direction as its axial direction. The second pin 82A is supported by the left and right side walls of the presser holder 74. Furthermore, a holder spring 83 is mounted on the second pin 82A. The holder spring 83 is configured as a torsion spring. With such an arrangement, in a plan view as viewed from the right side, the holder spring 83 applies a force to the feed foot supporting member 82 in a clockwise direction. The feed foot supporting member 82 is arranged such that its rear end portion comes in contact with the first pin 76 so as to limit the turning of the feed foot supporting member 82. Furthermore, a pair of left and right crank grooves 82B are respectively formed as through holes in left and right side walls of the feed foot supporting member 82 in order to couple the feed foot supporting member 82 to the upper feed foot 84 described later.

The upper feed foot 84 is configured in an approximately rectangular bar-shaped and crank-shaped structure as viewed in a side view from the right side. The upper feed foot 84 is arranged within an internal space in the width direction of the feed foot supporting member 82 and within an internal space of the presser holder 74. Specifically, the upper feed foot 84 is configured including an upper-side foot portion 84A extending in the front-back direction, an intermediate foot portion 84B extending from the front end portion of the upper-side foot portion 84A toward the lower side, and a lower-side foot portion 84C extending from the lower end portion of the intermediate foot portion 84B toward the front side.

A coupling tab 84D is monolithically formed in the rear end portion of the upper-side foot portion 84A such that it extends upward and curves toward the front side. With this arrangement, a rear coupling groove 84E configured as a "feed coupling portion" having an opening facing the front side is formed in the rear end portion of the upper-side foot portion 84A. A coupling shaft 40R on the rear side of the second feed arm 40 described above is inserted into the rear coupling groove 84E (see FIG. 2). Furthermore, a front coupling groove 84F configured as a "feed coupling portion" having an opening facing the upper side is formed in the front end portion of the upper-side foot portion 84A. The front coupling groove 84F is configured such that it passes through in the left-right direction. In a side view, the front coupling groove 84F is configured in an approximately U-shaped structure. A coupling shaft 40F provided on the front side of the second feed arm 40 described above is inserted into the front coupling groove 84F (see FIG. 2). With this arrangement, the upper feed foot 84 (upper feed mechanism 80) is detachably coupled to the second feed arm 40 (feed driving mechanism unit 32).

The intermediate foot portion 84B is provided with a pair of left and right coupling pins 84P. The coupling pins 84P are each configured in an approximately cylindrical shape with the left-right direction as their axial direction and such that they protrude from the upper feed foot 84 toward the outer sides in the width direction. With such an arrangement, the coupling pins 84P are slidably inserted into the crank grooves 82B formed in the feed foot supporting member 82. Furthermore, a spring mounting portion 84G is formed in the lower end portion of the intermediate foot portion 84B, which allows the feed dog force-applying spring 88 described later to be mounted. The spring mounting portion 84G is configured as a recess having an opening facing the right side and the lower side. Furthermore, a spring mounting boss 84H is monolithically formed in the spring mounting portion 84G. The spring mounting boss 84H is configured in an approximately cylindrical shape with the left-right direction as its axial direction such that it protrudes from the spring mounting portion 84G toward the right side.

The lower-side foot portion 84C is arranged at a position closer to the left side than the upper-side foot portion 84A and the intermediate foot portion 84B. The lower-side foot portion 84C is configured such that its front end portion curves toward the lower side. Furthermore, a pair of left and right hollow portions 84J are formed in the front end portion of the lower-side foot portion 84C. The hollow portions 84J are each configured in the form of a recess having an opening facing the lower side and the outer side in the width direction. With this arrangement, a coupling tab 84K is formed in the end portion of the lower-side foot portion 84C with a width-direction thickness that is smaller than that of the other portions.

In a front view as viewed from the front side, the upper feed dog 86 is configured in an approximately U-shaped block structure having an opening facing the upper side. Specifically, the upper feed dog 86 is configured including a bottom wall 86A, and a pair of left and right side walls 86B respectively extending upward from both end portions of the bottom wall 86A in its width direction. Furthermore, the upper feed dog 86 is designed such that the distance between the pair of side walls 86B in the left-right direction is slightly larger than the thickness of the coupling tab 84K of the feed foot supporting member 82. With such an arrangement, the coupling tab 84K is arranged between the left and right side walls 86B of the upper feed dog 86. The side walls 86B of the upper feed dog 86 are rotatably coupled to the coupling tab 84K by a coupling pin 89 with the left-right direction as its axial direction.

Here, the upper feed dog 86 is designed such that its width size is slightly smaller than the width size of the insertion opening 78B formed in the presser tab 78. With such an arrangement, the upper feed dog 86 is arranged immediately above the insertion opening 78B such that it can be inserted into the insertion opening 78B (see FIG. 4B). That is to say, in a plan view, the upper feed dog 86 is arranged immediately above the left second tooth portion 28B of the lower feed dog 28. Furthermore, multiple teeth are formed on the lower face of the bottom wall 86A of the upper feed dog 86. The teeth are arranged in the front-back direction. When the upper feed mechanism 80 is operated, this arrangement allows a sewing target to be fed in a state in which the sewing target is interposed between the upper feed dog 86 and the left side second tooth portion 28B of the lower feed dog 28 in the upper-lower direction.

Furthermore, an engagement wall 86C is monolithically formed in a lower portion of the rear end portion of the upper feed dog 86 such that it is positioned further on the rear side than the engagement pin 89, which allows the feed dog force-applying spring 88 described later to be engaged. The engagement wall 86C is configured such that it extends upward from the bottom wall 86A of the upper feed dog 86. An engagement groove 86D is formed in the upper end portion of the engagement wall 86C such that it is positioned at the central portion in the width direction. As viewed from the rear side, the engagement groove 86D is configured in an approximately V-shaped structure having an opening facing the upper face.

The feed dog force-applying spring 88 is configured as a torsion spring. With such an arrangement, the feed dog force-applying spring 88 is mounted on the spring mounting boss 84H of the upper feed dog foot 84. One end portion of the feed dog force-applying spring 88 is engaged with the engagement groove 86D of the upper feed dog 86. The other end portion of the feed dog force-applying spring 88 is engaged with the upper feed foot 84. With this arrangement, the rear end portion of the upper feed dog 86 is forced downward. In this state, as viewed from the right side, a force is applied to the upper feed dog 86 in a clockwise direction. Furthermore, the bottom wall 86A of the upper feed dog 86 comes in contact with the coupling tab 84K. This limits the turning of the upper feed dog 86. In a state in which the upper feed dog 86 does not come in contact with the lower feed dog 28, the upper feed dog 86 is tilted such that the front end portion of the upper feed dog 85 is lifted.

Here, when the presser unit 70 is to be fixedly mounted on the presser bar 14, after the presser bar 14 is moved upward by the operating lever 15, the presser unit 70 is temporarily mounted on the presser bar 14 by a fixing screw SC. Subsequently, by operating the operating lever 15, the presser unit 70 thus temporarily mounted is moved downward together with the presser bar 14. After the presser tab 78 comes in contact with the upper face of the needle plate 26, the fixing screw SC is subjected to final tightening so as to fixedly mount the presser unit 70 on the presser bar 14. Accordingly, in a state in which the presser unit 70 has been fixedly mounted on the presser bar 14, the presser tab 78 is positioned such that the lower face of the presser tab 78 comes in contact with the upper face of the needle plate 26. Furthermore, when the sewing machine 10 is operated, the lower feed dog 28 is raised. In this state, the upper end of the lower feed dog 28 is pressed in contact with the lower end of the upper feed dog 86, thereby turning the upper feed dog 86 thus tilted. As a result, the upper feed dog 86 is arranged in parallel with the lower feed dog 28.

Operations and Effects

Next, referring to FIGS. 8 and 9, description will be made regarding the operations and effects of the present embodiment with reference to the operation of the sewing machine 10. It should be noted that FIGS. 8 and 9 are side views of the sewing machine 10 as viewed from the right side. Also, in the lower portions of FIGS. 8 and 9, the periodical feeding operation of the lower feed dog 28 is schematically shown by a line of alternately long and two short dashes. The position of the lower feed dog 28 is indicated by a dot.

Figure 8A:
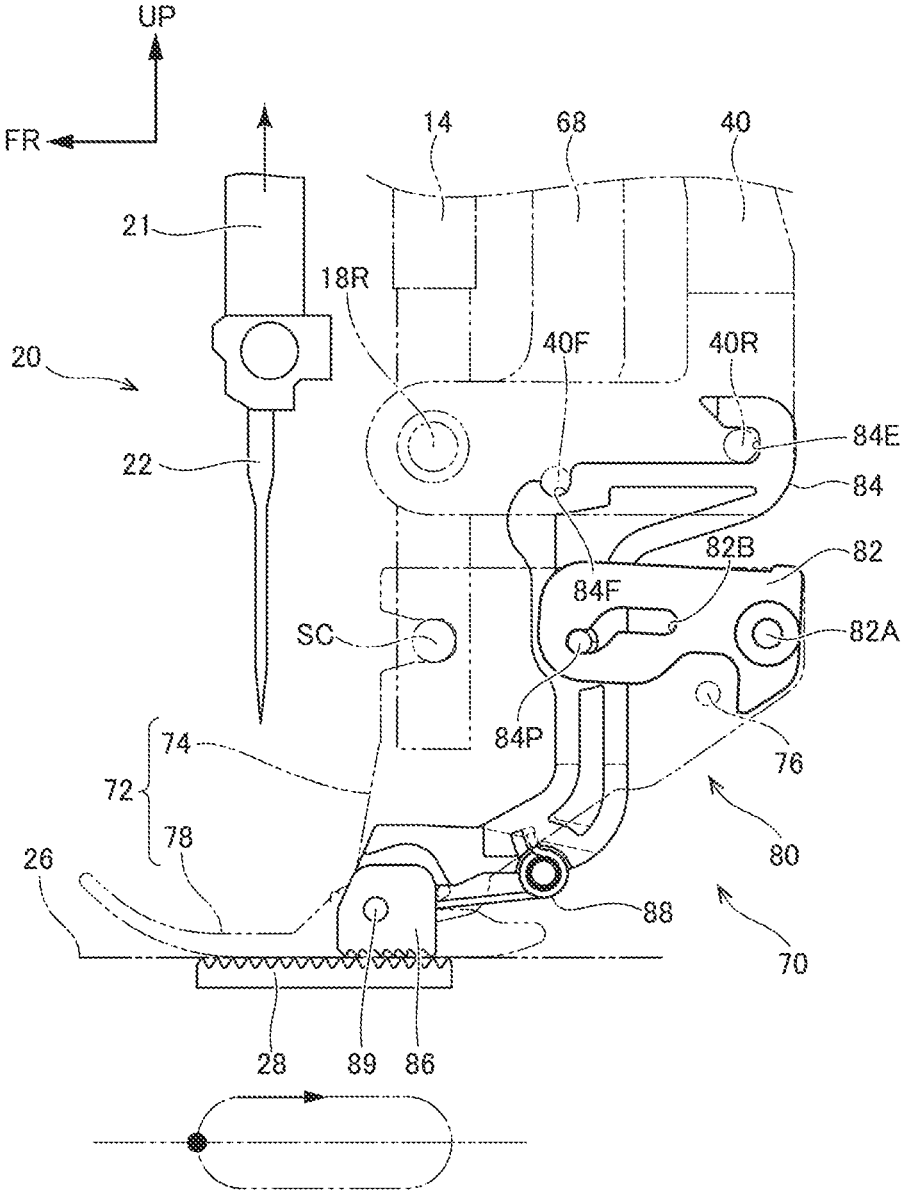
FIGS. 8A and 8B are side views as viewed from the right side for explaining the operation of the sewing machine, and specifically.
Figure 8B:
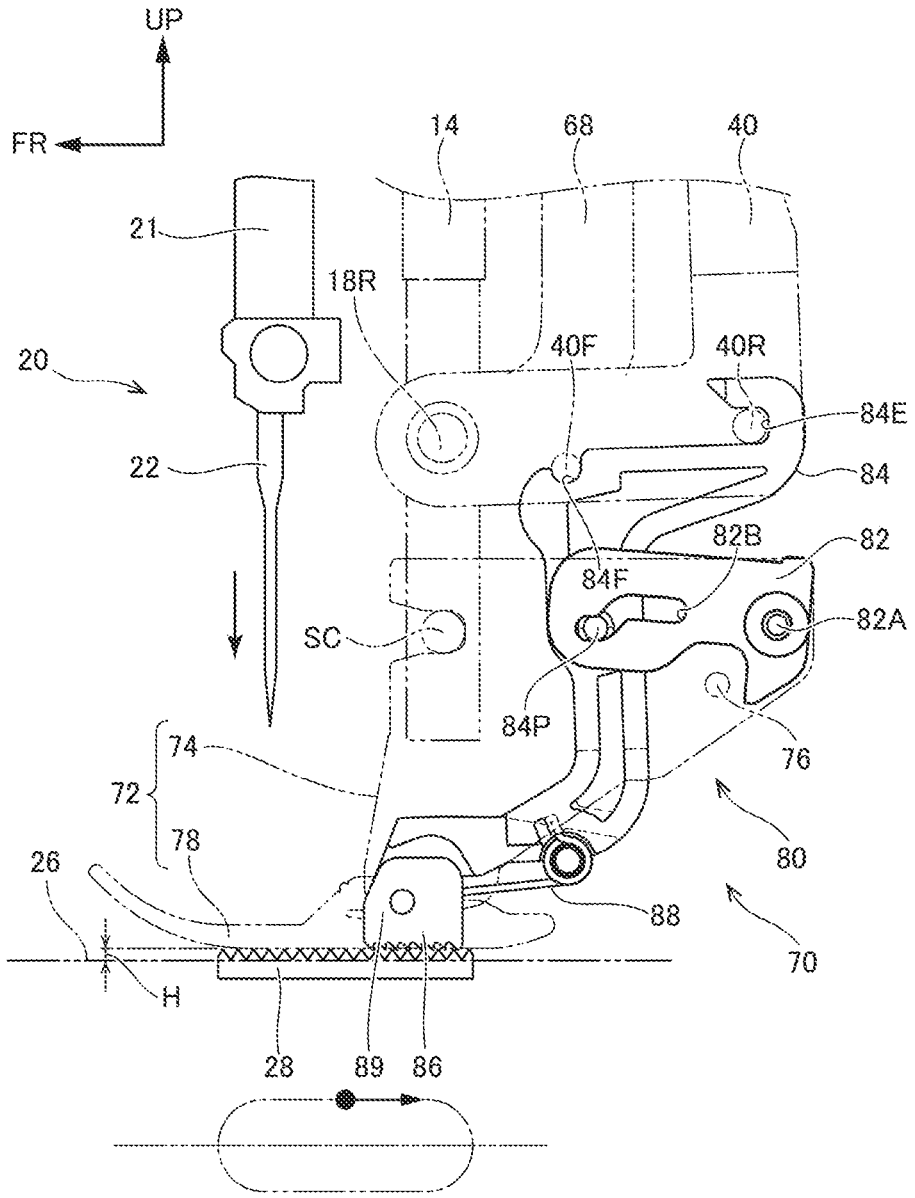
Figure 9A:
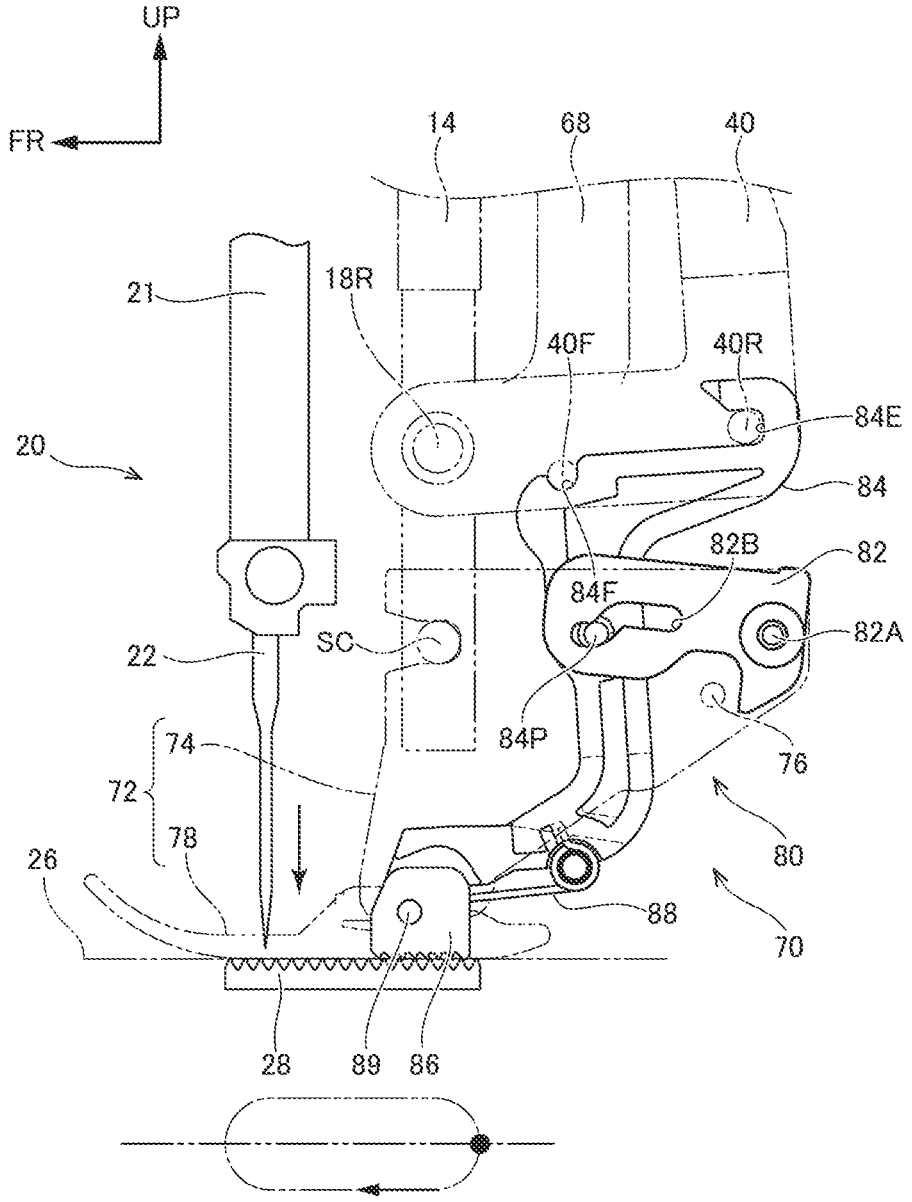
FIGS. 9A and 9B are side views as viewed from the right side for explaining the operation of the sewing machine, and specifically.

Regarding the Operation of the Needle Mechanism 20 from a Step in which it is Raised to a Top Dead Center from a Point Before the Top Dead Center Up to a Step in which it is Lowered from the Top Dead Center to a Position Before the Needle Plate As shown in FIGS. 8A and 8B and FIG. 9A, in this operation, the upper shaft 46 (not shown in FIGS. 8 and 9) is turned around its axis. This allows the crank mechanism to raise the needle mechanism 20 from a position before the top dead center to the top dead center, and to lower the needle mechanism 20 from the top dead center to a position before the needle plate position. Furthermore, in this operation, the lower shaft is also turned together with the upper shaft 46. This moves the lower feed dog 28 of the lower feed mechanism such that it protrudes further upward than the needle plate 26 and moves toward the rear side, so as to feed a sewing target toward the rear side. Specifically, as shown in FIG. 8A, the upper end of the lower feed dog 28 is raised to a position that matches the upper face of the needle plate 26, and the feeding operation of the lower feed dog 28 for the sewing target is started. Subsequently, as shown in FIG. 8B, the lower feed dog 28 is further raised from the position shown in FIG. 8A, and is displaced toward the rear side. In this state, the upper end of the lower feed dog 28 is displaced such that it protrudes from the upper face of the needle plate 26, and the sewing target is fed toward the rear side (see FIG. 8B). Subsequently, as shown in FIG. 9A, the upper end of the lower feed dog 28 is lowered to a position that matches the upper face of the needle plate 26, and the feeding operation of the lower feed dog 28 for the sewing target is completed.

Also, in this operation, accompanying the operation of the lower feed mechanism (lower feed dog 28), the feed driving mechanism unit 32 is operated. Specifically, as shown in FIG. 2, the feed shaft 34 is turned around its axis in a counterclockwise manner (in the direction indicated by the arrow A1 in FIG. 2). This turns the first feed arm 36 in a counterclockwise manner with the feed shaft 34 as its rotational center, and turns the second feed arm 40 in a clockwise manner (in a direction indicated by the arrow B1 in FIG. 2) with the support shaft 18L as its rotational center. With such an arrangement, the coupling shafts 40F and 40R of the second feed arm 40 are each coupled to the upper feed foot 84. This allows the upper feed foot 84 to be turned with the support shaft 18L as its rotational center together with the second feed arm 40. Accordingly, the upper feed dog 86 coupled to the lower end portion (lower-side foot portion 84C) of the upper feed foot 84 is displaced toward the rear side, which allows the upper feed dog 86 to feed the sewing target toward the rear side together with the lower feed dog 28. Specifically, in a state shown in FIG. 8A, the lower end of the upper feed dog 86 is arranged at a position that matches the upper face of the needle plate 26. With this arrangement, the sewing target S is fed toward the rear side in a state in which it is interposed between the lower feed dog 28 and the upper feed dog 86 in the upper-lower direction. With such an arrangement, in the operation from a step shown in FIG. 8A in which the needle mechanism 20 is set at a position before the top dead center up to a step shown in FIG. 9A in which it reaches a position before the needle plate, the upper feed dog 86 feeds the sewing target toward the rear side together with the lower feed dog 28.

When the sewing target is interposed between the upper feed dog 86 and the lower feed dog 28 in the upper-lower direction, the spring presser release mechanism 50 is operated so as to release the force applied by the presser spring 16 to the presser bar 14. Specifically, as shown in FIG. 2, accompanying the turning of the upper shaft 46, the cam 52 is turned, which turns the driven lever 54 in a clockwise manner with the feed shaft 34 as its rotational center. The bell crank 64 is coupled to the driven-side coupling shaft 54B of the driven lever 54 by the coupling link 66. Accordingly, in this case, the bell crank 64 is driven such that it turns in a counterclockwise manner with the switching shaft 62B as its rotational axis. This displaces the switching arm 68 coupled to the second coupling shaft 64C of the bell crank 64 and the support shaft 18L toward the lower side.

On the other hand, the upper end of the lower feed dog 28 (first tooth portions 28A and second tooth portions 28B) are set such that they protrude from the upper face of the needle plate 26. In this state, the lower feed dog 28 directly or otherwise indirectly (via the sewing target) comes in contact with the upper feed dog 86. That is to say, the lower feed dog 28 limits the displacement of the upper feed dog 86 toward the lower side. Accordingly, this also limits the displacement toward the lower side of the support shaft 18L coupled to the upper feed dog 86 via the upper feed foot 84 and the second feed arm 40. This turns the bell crank 64 in a counterclockwise manner with the second coupling shaft 64 as its rotational center, which displaces the switching shaft 62B of the presser spring holder 62 toward the upper side. As a result, the presser spring holder 62 is lifted (relatively moved upward) with respect to the presser bar 14, and is displaced to the release position. This releases the force applied by the presser spring 16 to the presser bar 14. That is to say, this arrangement allows the presser tab 78 to move upward according to the relative displacement amount L designed for the presser spring holder 62. This moves the presser tab 78 upward away from the upper face of the needle plate 26 together with the lower feed dog 28 (see FIG. 8B).

Subsequently, before the needle mechanism 20 is lowered to the needle plate position, the turning of the driven lever 54 is reversed according to the shape of the cam face of the cam 52. As a result, the presser spring holder 62 is displaced toward the lower side from the release position to the transmission position. With this arrangement, before the needle mechanism 20 reaches the needle plate position, the presser spring holder 62 is returned to a state in which the force applied by the presser spring 16 is transmitted to the presser bar 14.

Figure 9B:
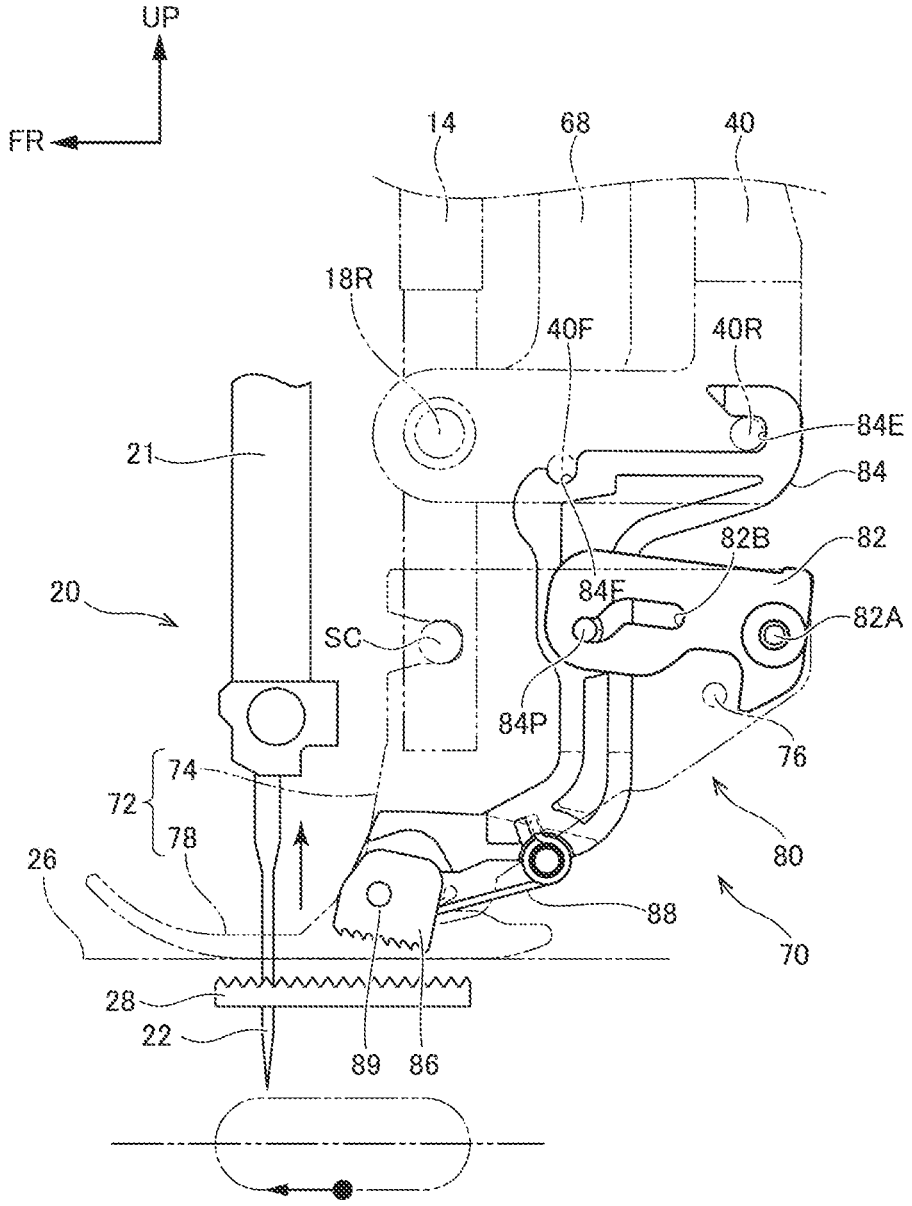

Regarding Operation of the Needle Mechanism 20 from a Step in which it is Lowered to the Bottom Dead Center from a Position Before the Needle Plate to a Step in which it is Raised from the Bottom Dead Center to a Position Before the Top Dead Center As shown in FIG. 9B, in this operation, the upper shaft 46 is turned around its axis. This allows the crank mechanism to lower the needle mechanism 20 from a position before the needle plate to the bottom dead center, and to raise the needle mechanism 20 up to a position before the needle plate. Furthermore, in this operation, the lower shaft is also turned together with the turning of the upper shaft 46. Accordingly, the lower feed dog 28 of the lower feed mechanism is displaced toward the lower side and the front side, which returns this arrangement to a state before the sewing target had been fed.

On the other hand, as shown in FIG. 2, accompanying the operation of the lower feed mechanism (lower feed dog 28), the feed shaft 34 is turned around its axis in a clockwise manner (in a direction indicated by the arrow A2 in FIG. 2). This turns the first feed arm 36 in a clockwise manner with the feed shaft 34 as the rotational center, and turns the second feed arm 40 in a counterclockwise manner (in a direction indicated by the arrow B2 in FIG. 2) with the support shaft 18L as the rotational center. With such an arrangement, as described above, the feed foot 84 is coupled to the coupling shafts 40F and 40R of the second feed arm 40. Accordingly, the upper feed foot 84 is turned in a counterclockwise manner with the support shaft 18L as the rotational center together with the second feed arm 40. With this arrangement, the upper feed dog 86 coupled to the lower end portion (lower-side foot portion 84C) of the upper feed foot 84 is displaced to the front side.

It should be noted that, with the spring presser release mechanism 50, upon turning the upper shaft 46, the cam 52 is turned, which turns the driven lever 54 in a counterclockwise manner with the feed shaft 34 as the rotational center. This applies a force toward the front side to the first coupling shaft 64B of the bell crank 64 coupled to the driven lever 54 via the coupling link 66, which turns the bell crank 64 in a clockwise manner with the switching shaft 62B as the rotational center. This displaces the switching arm 68 coupled to the bell crank 64 toward the upper side, and displaces the support shaft 18L toward the upper side with respect the presser bar 14. Accordingly, as shown in FIG. 9B, the upper feed dog 86 coupled to the support shaft 18R via the second feed arm 40 and the upper feed foot 84 is also displaced toward the upper side away from the lower feed dog 28. Accordingly, the upper feed dog 86 is turned around the axis of the coupling pin 89 by the force applied by the feed dog force-applying spring 88. This tilts the upper feed dog 86 such that the front end portion of the upper feed dog 86 is lifted. Subsequently, the turning of the driven lever 54 is reversed according to the shape of the cam face of the cam 52, which returns the upper feed dog 86 to a state shown in FIG. 8A.

Before the sewing of the sewing target is started, the sewing target is set on the front side of the sewing needle 22, and is inserted from the front side into a gap between the presser tab 78 and the lower feed dog 28 in order to feed the sewing target. With the sewing machine 10 according to the present embodiment, the entire region of the upper feed dog 86 of the presser unit 70 is arranged on the rear side of the needle location position of the sewing needle 22. Accordingly, when the sewing operation is started for the sewing target (i.e., when the feeding operation is started for the sewing target), the sewing target does not reach the upper feed dog 86. In this state, the sewing target is interposed between the lower feed dog 28 and the presser tab 78 in the upper-lower direction. That is to say, in this stage, the sewing target is fed by the lower feed dog 28. In contrast, when the sewing target is fed by the upper feed dog 86, as described above, the spring presser release mechanism 50 is operated, which releases the force applied by the presser spring 16 to the presser bar 14. In this stage, in some cases, this arrangement involves a large space between the lower feed dog 28 arranged on the front side of the sewing needle 22 and the presser tab 78. Accordingly, with the sewing machine 10 having a configuration in which the entire region of the upper feed dog 86 is arranged on the rear side of the needle location position of the sewing needle 22, this arrangement has the potential to cause an issue in that the sewing target interposed between the lower feed dog 28 and the presser tab 78 cannot be fed satisfactorily when the feeding operation for the sewing target is started (on the front side of the sewing needle 22).

With the sewing machine 10 according to the present embodiment, the relative movement amount L to be set for the presser bar 14 of the presser spring holder 62 when the spring presser release mechanism 50 is operated is designed to be the same as the protrusion height H by which the lower feed dog 28 protrudes from the upper face of the needle plate 26. Accordingly, even in a case of the sewing machine 10 having a configuration in which the entire region of the upper feed dog 86 is arranged on the rear side of the needle location position of the sewing needle 22, the sewing target is interposed between the lower feed dog 28 and the presser tab 78 when the feeding operation is started for the sewing target (the front side of the sewing needle 22). Accordingly, this arrangement is capable of feeding the sewing target toward the rear side with satisfactory performance. Description will be made below regarding this point in comparison with a sewing machine 100 according to a comparison example shown in FIG. 1B.

First, description will be made regarding the sewing machine 100 according to a comparison example shown in FIG. 1B. The sewing machine 100 according to the comparison example has the same configuration as that of the sewing machine 10 according to the present embodiment except for the point of difference described below. It should be noted that, in the following description, the components of the sewing machine 100 configured in the same manner as those of the sewing machine 10 according to the present embodiment are indicated by the same reference symbols.

That is to say, the sewing machine 100 according to the comparison example includes the upper feed dog 86 as with the sewing machine 10 according to the present embodiment. The sewing machine 100 has a configuration for suppressing the effect of the pressing force applied by the presser tab 78 when the sewing target S is fed by the lower feed dog 28 and the upper feed dog 86. Specifically, the relative movement amount L to be set for the presser bar 14 of the presser spring holder 62 when the spring presser release mechanism 50 is operated is designed to be relatively larger than the protrusion height H by which the lower feed dog 28 protrudes from the upper face of the needle plate 26.

With such an arrangement, as shown in FIG. 1B, when the feeding operation is started for the sewing target S, the sewing target S has not reached the upper feed dog 86. Accordingly, the lower feed dog 28 displaced upward is pressed in contact with the upper feed dog 86, which operates the spring presser release mechanism 50. In the same manner as described above, this raises the presser spring holder 62 from the transmission position to the release position. This releases the force applied by the presser spring 16 to the presser bar 14, which allows the presser bar 14 to be raised. That is to say, this allows the presser tab 78 to be raised from the upper face of the needle plate 26 by the relative movement amount L (the position of the presser tab 78 in this stage will be referred to as the "raised position" hereafter; in FIG. 1, the presser tab 78 has been raised up to the raised position).

On the other hand, the lower feed dog 28 is set such that it protrudes upward from the needle plate 26 by the protrusion height H. In the sewing machine 100 according to the comparison example, as described above, the relative movement amount L set for the presser bar 14 of the presser spring holder 62 when the spring presser release mechanism 50 is operated is designed to be relatively larger than the protrusion height H by which the lower feed dog 28 protrudes from the upper face of the needle plate 26. Accordingly, when the presser tab 78 is raised up to the raised position, the presser tab 78 is positioned further on the upper side than the upper end (first tooth portions 28A and second tooth portions 28B) of the lower feed dog 28. That is to say, this arrangement involves a gap between the presser tab 78 arranged at the raised position and the sewing target S.

Subsequently, the feeding operation for the sewing target S is started. After the sewing target S is interposed between the lower feed dog 28 (left-side first tooth portion 28A) and the presser tab 78 (front presser portion 78F) in the upper-lower direction, the presser tab 78 is lifted by the sewing target S. In this operation, if the sewing target S has a thickness that is smaller than the gap G, the presser tab 78 does not reach the raised position. In this state, the force applied by the presser spring 16 to the presser tab 78 has no effect on the sewing target S. In this case, when the feeding operation is started for the sewing target S, the sewing target S cannot be satisfactorily held by the lower feed dog 28 (left-side first tooth portion 28A) and the presser tab 78 (front presser portion 78F). That is to say, this arrangement has the potential to cause an issue in that the sewing target S cannot be fed toward the rear side by the lower feed dog 28.

In contrast, the sewing machine 10 according to the present embodiment is designed such that the coupling position of the coupling pin 89 for the coupling tab 84K is approximately 0.7 mm higher compared with that of the sewing machine 100 according to the comparison example. With this arrangement, the position of the upper feed dog 86 in the upper feed mechanism 80 becomes higher according to the coupling position. Accordingly, when the feeding operation is started, the position of the upper feed dog 86 with the lower feed dog 28 as a reference is higher compared with that of the sewing machine 100 according to the comparison example. This generates a delay in the timing at which the sewing target S is held by the upper feed dog 86 and the lower feed dog 28 such that it is interposed between the upper side and the lower side (timing at which the lower feed dog 28 displaced upward comes in contact with the upper feed dog 86). This delay in timing also leads to a delay in the timing at which the operation of the spring presser release mechanism 50 is started, and has an effect on the relative movement amount L to be set for the presser bar 14 of the presser spring holder 62. As described above, the relative movement amount L to be set for the presser bar 14 of the presser spring holder 62 when the spring presser release mechanism 50 is operated is designed to be the same as the protrusion height H by which the lower feed dog 28 is raised from the upper face of the needle plate 26. Accordingly, as shown in FIG. 1A, when the spring presser release mechanism 50 is operated after the feeding operation for the sewing target S is started, this arrangement allows the presser tab 78 to rise up to the raised position. When the presser tab 78 reaches the raised position, the position of the lower face of the presser tab 78 matches the position of the upper end of the lower feed dog 28 in the upper-lower direction. That is to say, with the sewing machine 10 according to the present embodiment, the raised position to be set for the presser tab 78 is designed to be lower compared to that of the sewing machine 100 according to the comparison example. Thus, this arrangement involves no gap G between the presser tab 78 and the lower feed dog 28.

With such an arrangement, when the presser tab 78 is raised together with the lower feed dog 28, the presser bar 14, the presser bar holder 58, and the spring receiver 60 are relatively moved upward with respect to the presser spring holder 62. When the presser tab 78 reaches the raised position, the spring receiver 60 is pressed in contact with the upper wall 62U of the presser spring holder 62 from the lower side. That is to say, when the presser tab 78 reaches the raised position, the presser spring holder 62 is set to the transmission position, returning to a state in which the force is applied by the presser spring 16 to the presser bar 14.

Accordingly, when the sewing target S is interposed between the lower feed dog 28 (left-side first tooth portion 28A) and the presser tab 78 (front presser portion 78F) in the upper-lower direction after the feeding operation is started for the sewing target S, the presser tab 78 (presser bar 14) is raised by the thickness of the sewing target S from the raised position against the force applied by the presser spring 16. With this arrangement, a force is applied by the presser spring 16 to the sewing target S via the presser tab 78 (front presser portion 78F), thereby allowing the sewing target S to be interposed between the lower feed dog 28 and the presser tab 78 in the upper-lower direction. Accordingly, this arrangement is capable of satisfactory feeding the sewing target S toward the rear side by the lower feed dog 28 (left-side first tooth portion 28A).

As described above, even in a case of the sewing machine 10 including the upper feed dog 86 such that its entire region is arranged on the rear side of the needle location point of the sewing needle 22, this arrangement is capable of satisfactorily feeding the sewing target S toward the rear side when the feeding operation is started for the sewing target S. Accordingly, this arrangement provides improved feeding performance for the sewing target S.

Furthermore, in the present embodiment, as described above, the upper feed dog 86 is arranged such that the entire region thereof is positioned on the rear side of the needle location point of the sewing needle 22. This allows the upper feed dog 86 to be designed with a relatively small width size. This allows the presser tab 78 to be designed with a relatively small width size. This arrangement provides the operator with improved convenience.

That is to say, in a case in which the upper feed dog 86 is arranged such that its region also overlaps the front side of the sewing needle 22, for example, as viewed in a plan view, the upper feed dog 86 is configured in an approximately U-shaped structure having an opening facing the front side such that both of its end portions along the width direction are positioned on the left side and the right side with respect to the sewing needle 22. This involves the upper feed dog 86 having a larger width size compared to that designed in the present embodiment. This also involves the presser tab 78 having a large width size. With such an arrangement, in a case in which the upper feed dog 86 and the presser tab 78 are each configured to have a large width size, this arrangement has the potential to lead to degraded visibility for the sewing margin in the sewing operation. Furthermore, in a case in which the upper feed dog 86 and the presser tab 78 each have a large width size, this involves an increase in the contact area between the upper feed dog 86 and the presser tab 78 extending in the width direction. Accordingly, for example, this arrangement has the potential to involve degraded operability when the sewing operation is performed for the sewing target S while turning the sewing target S to the right side or otherwise the left side.

In contrast, in the present embodiment, as described above, the upper feed dog 86 is arranged such that its entire region is positioned on the rear side of the needle location point of the sewing needle 22. This allows the upper feed dog 86 to be designed with a relatively small width size. Furthermore, this allows the presser tab 78 to be designed with a relatively small width size. Accordingly, this arrangement provides improved visibility for a sewing margin in the sewing operation, and provides improved operability for the sewing target S. Accordingly, this arrangement provides the operator with improved convenience in the sewing operation.

Furthermore, in the upper feed mechanism 80, the feed dog force-applying spring 88 is configured as a torsion spring to force the rear end portion of the upper feed dog 86 toward the lower side. With such an arrangement, the feed dog force-applying spring 88 is mounted on the spring mounting boss 84H of the upper feed foot 84. In this state, one end portion of the feed dog force-applying spring 88 is engaged with the engagement groove 86D of the upper feed dog 86, and the other end portion of the feed dog force-applying spring 88 is engaged with the upper feed foot 84. This allows the upper feed dog 86 to be effectively designed to have a small width size. Furthermore, this allows the presser tab 78 to be effectively designed to have a small width size. Accordingly, this arrangement provides the operator with further improved convenience in the sewing operation.

Figure 10:
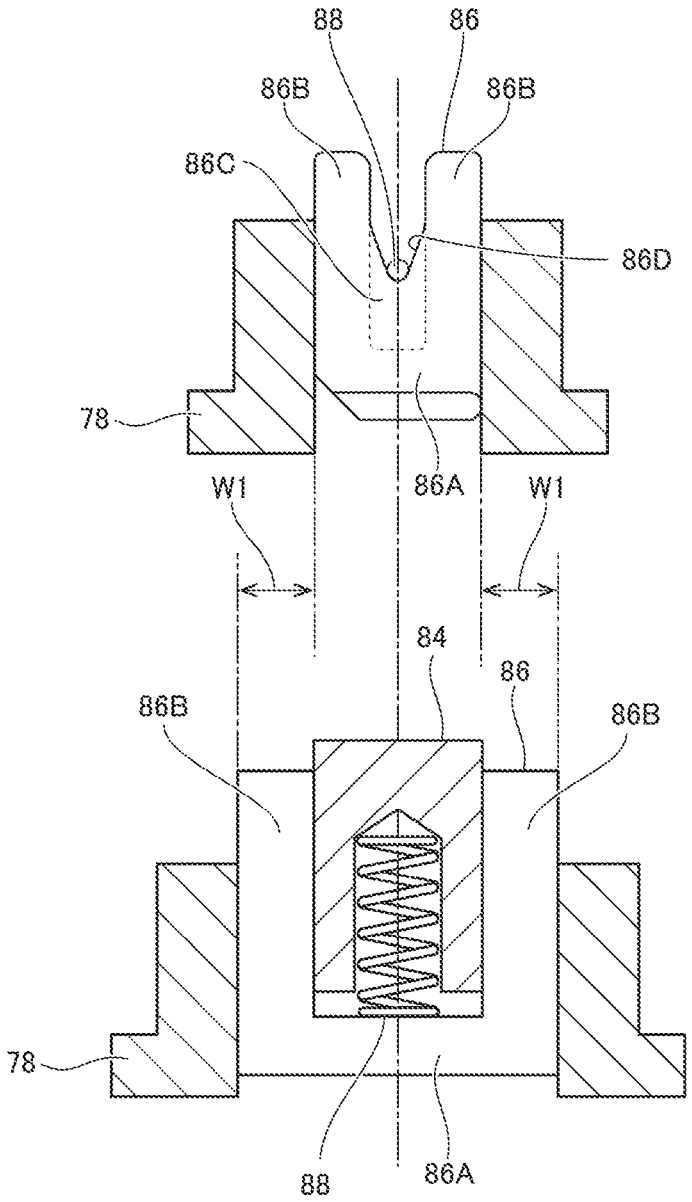
FIG. 10 is an explanation diagram for explaining the width size of the upper feed dog required to be changed in a case in which a feed dog force-applying spring shown in FIG. 7 is changed to a compression coil spring.

That is to say, for example, in a case in which the feed dog force-applying spring 88 that forces the rear end portion of the upper feed dog 86 toward the lower side is configured as a compression coil spring as with the sewing machine described in the related art, there is a need to engage both ends of the feed dog force-applying spring 88 with the upper feed foot 84 and the upper feed dog 86 while maintaining the orientation of the feed dog force-applying spring 88. Accordingly, in this case, as shown in the lower side of FIG. 10, for example, a recess portion is formed in the upper feed foot 84 in order to allow the feed dog force-applying spring 88 to be housed. The upper feed dog 84 is arranged between the left-side and right-side walls 86B of the upper feed dog 86. With this arrangement, the upper feed dog 86 is rotatably coupled to the upper feed foot 84. In this case, the recess portion formed in the upper feed foot 84 is required to have a width size that is larger than the outer diameter of the feed dog force-applying spring 88. This involves a tendency for the upper feed dog 86 to have a relatively large width size.

In contrast, in the present embodiment, the feed dog force-applying spring 88 is configured as a torsion spring. With such an arrangement, the feed dog force-applying spring 88 is mounted on the upper feed foot 84. In this state, one end portion of the feed dog force-applying spring 88 is engaged with the engagement groove 86D of the upper feed dog 86. Accordingly, the groove width of the engagement groove 86D of the upper feed dog 86 is only required to be sufficient for engaging one end portion of the feed dog force-applying spring 88. That is to say, the engagement groove 86D may preferably be configured with a groove width that is slightly larger than the line diameter of the feed dog force-applying spring 88. Accordingly, with the present embodiment, this arrangement allows the upper feed dog 86 to be designed with a width size that is W1 smaller for each side as compared with an arrangement in which the feed dog force-applying spring 102 is configured as a compression coil spring as shown in the upper side of FIG. 10. Accordingly, this also allows the presser tab 78 to be designed with a smaller width size as compared with the arrangement shown in the lower side of FIG. 10. Accordingly, this arrangement provides the operator with further improved convenience in the sewing operation.

Furthermore, in the present embodiment, the presser tab 78 is arranged at a position closer to the left side with respect to the central portion of the lower feed dog 28 in the width direction. Specifically, in a plan view, the presser tab 78 is arranged at a position with respect to the lower feed dog 28 in the left-right direction such that the left end portion of the presser tab 78 overlaps the left-side first tooth portion 28A of the lower feed dog 28. Accordingly, even in a case in which the presser tab 78 is configured with a relatively small width size, this arrangement is capable of feeding the sewing target S toward the rear side in a state in which the sewing target S is interposed between the front presser portion 78F of the presser tab 78 and the left-side first tooth portion 28A of the lower feed dog 28 in the upper-lower direction.

That is to say, in a case in which the presser tab 78 is arranged such that the position of the central portion of the width direction of the presser tab 78 matches the position of the central portion of the width direction of the lower feed dog 28, in a plan view, the presser tab 78 is arranged between a pair of the left and right first tooth portions 28A of the lower feed dog 28 because the presser tab 78 is designed with a relatively small width size. Accordingly, in this case, in a plan view, the left-side front presser portion 78F of the presser tab 78 does not overlap the left-side first tooth portion 28A. This arrangement is not capable of satisfactorily holding the sewing target S between the front presser portion 78F of the presser tab 78 and the first tooth portion 28A of the lower feed dog 28. Accordingly, this arrangement has the potential to cause an issue in that the sewing target S cannot be satisfactorily fed toward the rear side.

In contrast, with the present embodiment, in a plan view, the position of the presser tab 78 is determined in the left-right direction with respect to the lower feed dog 28 such that the left end portion of the presser tab 78 overlaps the left-side first tooth portion 28A of the lower feed dog 28. Accordingly, this arrangement is capable of feeding the sewing target S toward the rear side in a state in which the sewing target S is satisfactorily held by the front presser portions 78F of the presser tab 78 and the left-side first tooth portion 28A of the lower feed dog 28 arranged in the upper-lower direction.

Furthermore, in the present embodiment, the upper feed mechanism 80 is coupled to the presser main body 72, and are configured as a unit, i.e., as the presser unit 70. Furthermore, the coupling shafts 40F and 40R for the feed drive mechanism unit 32 are inserted into the rear coupling groove 84E and the front coupling groove 84F of the upper feed foot 84 in the upper feed mechanism 80 so as to detachably couple the upper feed mechanism 80 to the feed drive mechanism unit 32. Furthermore, the holder coupling portion 74A of the presser holder 74 is fixed to the presser bar 14 by fastening by the fixing screw SC, thereby detachably fixing the presser main body 72 to the presser bar 14. With this arrangement, by preparing various kinds of presser units, a suitable presser unit can be mounted on the sewing machine 10 according to the usage.

It should be noted that description has been made in the present embodiment regarding an arrangement in which the feed dog force-applying spring 88 that forces the rear end portion of the upper feed dog 86 toward the lower side is configured as a torsion spring. Also, the feed dog force-applying spring 88 may be configured as an approximately longitudinal leaf spring (plate spring). In this case, for example, an arrangement may be made in which one end portion of the feed dog force-applying spring configured as a leaf spring is engaged with the engagement groove 86D of the upper feed dog 86, and the other end portion of the feed dog force-applying spring is fixed to the upper feed foot 84. With this arrangement also, the groove width of the engagement groove 86D of the upper feed dog 86 only needs to be sufficient for the width size of the leaf spring. Accordingly, this arrangement also allows the upper feed dog 86 to be designed with a relatively small width as compared with an arrangement in which the feed dog force-applying spring is configured as a compression coil spring. Furthermore, this allows the presser tab 78 to be designed with a relatively small width size.

Description of the Reference Numerals

10 sewing machine, 12 sewing machine main body, 13 frame, 14 presser bar, 15 operating lever, 16 presser spring, 18 coupling member, 18L support shaft, 18R support shaft, 20 needle mechanism, 21 needle bar, 22 sewing needle (needle), needle plate, 26A first exposure opening, 26B second exposure opening, 28 lower feed dog, 28A first tooth portion, 28B second tooth portion, 30 upper feed driving mechanism, 32 feed driving mechanism unit (feed driving unit), 34 feed shaft, 36 first feed arm, 38 feed link, 40 second feed arm, 40A arm main portion, 40B arm coupling portion, 40C coupling opening, 40F coupling shaft, 40R coupling shaft, 42 auxiliary plate, 44 spacer, 46 upper shaft, 50 spring presser release mechanism, 52 cam, 54 driven lever, 54A lever portion, 54B driven-side coupling shaft, 56 force-applying spring, 58 presser bar holder, 58A protrusion, 60 spring receiver, 62 presser bar holder (transmission member), 62A slot, 62B switching shaft, 62H insertion opening, 62L lower wall, 62S side wall, 62U upper wall, 64 bell crank, 64A coupling cylinder portion, 64B first coupling shaft, 64C second coupling shaft, 66 coupling link, 68 switching arm, 68A coupling cylinder portion, 70 presser unit, 72 presser main body, 74 presser holder, 74A holder coupling portion (presser fixing portion), 74B presser bar mounting portion, 74C fixing groove, 74D presser mounting portion, 74E presser mounting groove, 74F mounting recess portion, 76 first pin, 78 presser tab (presser), 78A mounting wall, 78B insertion opening, 78C groove portion, 78F front presser portion, 79 mounting pin, 80 upper feed mechanism, 82 feed foot supporting member, 82A second pin, 82B crank groove, 83 holder spring, 84 upper feed foot (upper feed holder), 84A upper-side foot portion, 84B intermediate foot portion, 84C lower-side foot portion, 84D coupling tab, 84E rear coupling groove (feed coupling portion), 84F front coupling groove (feed coupling portion), 84G spring mounting portion, 84H spring mounting boss, 84J hollow portion, 84K coupling tab, 84P coupling pin, 86 upper feed dog, 86A bottom wall, 86B side wall, 86C engagement wall, 86D engagement groove, 88 feed dog force-applying spring, 89 coupling pin, 100 sewing machine, H protrusion height, L relative movement amount, S sewing target.

What is claimed is:

1. A sewing machine comprising:

a needle plate;

a presser bar;

a presser spring configured to apply a force to the presser bar toward a lower side;

a presser main body fixed to the presser bar, and comprising a presser that presses a sewing target;

a lower feed dog arranged below the presser, and configured to protrude upward from the needle plate, and to feed the sewing target toward a rear side;

an upper feed mechanism arranged above the lower feed dog, comprising an upper feed dog, wherein an entire body of the upper feed dog is arranged behind a needle location point, toward the rear side, such that the upper feed mechanism is configured to be operated so as to feed the sewing target toward the rear side by the upper feed dog and the lower feed dog;

a feed driving unit configured to drive the upper feed dog such that the upper feed dog performs an upper feeding operation; and a spring presser release mechanism mounted on the presser bar and configured to be moved relatively to the presser bar, and comprising a transmission member that transmits the force applied by the presser spring to the presser bar, wherein, when the lower feed dog comes in contact with the upper feed dog, the spring presser release mechanism controls the transmission member to move upwards with respect to the presser bar, so as to release the force applied to the presser bar;

wherein the spring presser release mechanism makes the transmission member move up and down within a distance with respect to the presser bar, the distance being the same as a protrusion height of the lower feed dog that protrudes upward from the needle plate; and wherein, when the transmission member is at a highest position within the distance, a bottom of the presser and a top of the lower feed dog are positioned at a same height position as one another.

2. The sewing machine according to claim 1, wherein the upper feed mechanism is coupled to the presser main body such that the upper feed mechanism and the presser main body are configured as a unit, wherein the upper feed mechanism comprises a feed coupling portion detachably coupled to the feed driving unit, and wherein the presser main body comprises a presser fixing portion detachably fixed to the presser bar.

* * * * *